US011367608B2

(12) United States Patent
Verenchikov

(10) Patent No.: US 11,367,608 B2
(45) Date of Patent: Jun. 21, 2022

(54) GRIDLESS ION MIRRORS WITH SMOOTH FIELDS

(71) Applicant: Micromass UK Limited, Wilmslow (GB)

(72) Inventor: Anatoly Verenchikov, City of Bar (ME)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 17/049,175

(22) PCT Filed: Apr. 23, 2019

(86) PCT No.: PCT/GB2019/051118
§ 371 (c)(1),
(2) Date: Oct. 20, 2020

(87) PCT Pub. No.: WO2019/202338
PCT Pub. Date: Oct. 24, 2019

(65) Prior Publication Data

US 2021/0242007 A1 Aug. 5, 2021

(30) Foreign Application Priority Data

Apr. 20, 2018 (GB) ..... 1806507

(51) Int. Cl.
*H01J 49/40* (2006.01)

(52) U.S. Cl.
CPC ..... *H01J 49/405* (2013.01); *H01J 49/406* (2013.01)

(58) Field of Classification Search
CPC ..... H01J 49/40; H01J 49/401; H01J 49/403; H01J 49/405; H01J 49/406
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

International Search Report and Written Opinion for International Application No. PCT/EP2017/070508 dated Oct. 16, 2017, 17 pages.
(Continued)

*Primary Examiner* — David E Smith

(57) ABSTRACT

An ion mirror 41 constructed of thin electrodes that are interconnected by resistive dividers 45 with potentials U1-U5 applied to knot electrodes to form segments 41-43 of linear potential distribution between the "knot" electrodes, yet without separating those field regions by meshes. Weak and controlled penetration of electric fields provide for a fine control over the field non linearity and over the equipotential line curvature, thus allowing to reach unprecedented level of ion optical quality: more than twice larger energy acceptance compared to thick electrode mirrors, up to sixth order time per energy focusing, ion spatial focusing and wide spatial acceptance. Novel mirrors can be formed very slim to arrange them into stacks for ion transverse displacement between ion reflections or for multiplexed mirror stacks. Printed circuit boards (PCB) are best suited for making novel ion mirrors, while novel ion mirrors are designed to suit PCB requirements.

20 Claims, 10 Drawing Sheets

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A 12/1998 Dresch
5,869,829 A 2/1999 Dresch
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos

(56) References Cited

U.S. PATENT DOCUMENTS 9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 * 1/2018 Verenchikov ..... H01J 49/405
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 * 8/2001 Franzen ..... H01J 49/401
250/287
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0026613 A1 2/2004 Bateman et al.
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0121130 A1 5/2009 Satoh
2009/0206250 A1 8/2009 Wollnik
2009/0250607 A1 10/2009 Staats et al.
2009/0272890 A1 11/2009 Ogawa et al.
2009/0294658 A1 12/2009 Vestal et al.
2009/0314934 A1 12/2009 Brown
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama
2013/0048852 A1 * 2/2013 Verenchikov ..... H01J 49/0031
250/282
2013/0056627 A1 3/2013 Verenchikov
2013/0068942 A1 3/2013 Verenchikov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054454 A1 2/2014 Hoyes et al.
2014/0054456 A1 * 2/2014 Kinugawa ..... G01N 27/62
250/287
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0239172 A1 8/2014 Makarov
2014/0246575 A1 9/2014 Langridge et al.
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0144779 A1 * 5/2015 Verenchikov ..... H01J 49/40
250/282
2015/0194296 A1 7/2015 Verenchikov et al.
2015/0228467 A1 8/2015 Grinfeld et al.
2015/0270115 A1 * 9/2015 Furuhashi ..... H01J 49/405
250/287
2015/0279650 A1 10/2015 Verenchikov
2015/0294849 A1 10/2015 Grinfeld et al.
2015/0318156 A1 11/2015 Loyd et al.
2015/0364309 A1 12/2015 Welkie
2015/0380233 A1 12/2015 Verenchikov
2016/0005587 A1 1/2016 Verenchikov
2016/0035558 A1 2/2016 Verenchikov et al.
2016/0079052 A1 3/2016 Makarov et al.
2016/0225598 A1 8/2016 Ristroph
2016/0225602 A1 8/2016 Ristroph et al.

(56) References Cited

U.S. PATENT DOCUMENTS

| | | | | |
|---|---|---|---|---|
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0098533 | A1 | 4/2017 | Stewart et al. | |
| 2017/0168031 | A1* | 6/2017 | Verenchikov | H01J 49/067 |
| 2017/0169633 | A1 | 6/2017 | Leung et al. | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0366312 | A1 | 12/2018 | Grinfeld et al. | |
| 2019/0019664 | A1 | 1/2019 | Furuhashi et al. | |
| 2019/0180998 | A1 | 6/2019 | Stewart et al. | |
| 2019/0206669 | A1 | 7/2019 | Verenchikov et al. | |
| 2019/0237318 | A1 | 8/2019 | Brown | |
| 2019/0360981 | A1 | 11/2019 | Verenchikov | |
| 2020/0083034 | A1 | 3/2020 | Verenchikov et al. | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov | |
| 2020/0243322 | A1 | 7/2020 | Stewart et al. | |
| 2020/0373142 | A1 | 11/2020 | Verenchikov | |
| 2020/0373143 | A1 | 11/2020 | Verenchikov et al. | |
| 2020/0373145 | A1 | 11/2020 | Verenchikov et al. | |

FOREIGN PATENT DOCUMENTS

| | | | |
|---|---|---|---|
| CN | 102131563 | A | 7/2011 |
| CN | 201946564 | U | 8/2011 |
| CN | 103684817 | A | 3/2014 |
| CN | 206955673 | U | 2/2018 |
| DE | 4310106 | C1 | 10/1994 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1789987 | A1 | 5/2007 |
| EP | 1901332 | A1 | 3/2008 |
| EP | 2068346 | A2 | 6/2009 |
| EP | 1665326 | B1 | 4/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2274197 | A | 7/1994 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | B2 | 3/2015 |
| JP | 2015185306 | A | 10/2015 |
| RU | 2564443 | C2 | 10/2015 |
| RU | 2015148627 | A | 5/2017 |
| SU | 1681340 | A1 | 9/1991 |
| SU | 1725289 | A1 | 4/1992 |
| WO | 9103071 | A1 | 3/1991 |
| WO | 1998001218 | | 1/1998 |
| WO | 1998008244 | A2 | 2/1998 |
| WO | 200077823 | A2 | 12/2000 |
| WO | 2005001878 | A2 | 1/2005 |
| WO | 2005043575 | A2 | 5/2005 |
| WO | 2006014984 | A1 | 2/2006 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012013354 | A1 | 2/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013098612 | A1 | 7/2013 |
| WO | 2013110587 | A | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A | 7/2014 |
| WO | 2014142897 | A1 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | A1 | 11/2016 |
| WO | 2017042665 | A1 | 3/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030474 | A1 | 2/2019 |

(56) References Cited

FOREIGN PATENT DOCUMENTS

| | | | |
|---|---|---|---|
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999. Abstract.
Toyoda et al., "Multi-Turn-Time-of-Flight Mass Spectometers with Electrostatic Sectors", Journal of Mass Spectrometry, 38: 1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:www.etp-ms.com/file-repository/21 [retrieved on Jul. 31, 2019].
Kaufmann, R., et al., "Sequencing of peptides in a time-of-flight mass spectrometer:evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019, 5 pages.
Combined Search and Examination Report for United Kingdom Application No. GB1901411.7 dated Jul. 31, 2019.
Extended European Search Report for EP Patent Application No. 16866997.6, dated Oct. 16, 2019.
Combined Search and Examination Report for GB 1906258.7, dated Oct. 25, 2019.
Combined Search and Examination Report for GB1906253.8, dated Oct. 30, 2019, 5 pages.
Search Report under Section 17(5) for GB1916445.8, dated Jun. 15, 2020.
International Search Report and Written Opinion for International application No. PCT/GB2020/050209, dated Apr. 28, 2020, 12 pages.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Carey, D.C., "Why a second-order magnetic optical achromat works", Nucl. Instrum. Meth., 189(203):365-367 (1981).
Yavor, M., "Optics of Charged Particle Analyzers", Advances in Imaging and Electron Physics Book Series, vol. 57 (2009) Abstract.
Sakurai, T. et al., "Ion optics for time-of-flight mass spectrometers with multiple symmetry", Int J Mass Spectrom Ion Proc 63(2-3):273-287 (1985).
Wollnik, H., "Optics of Charged Particles", Acad. Press, Orlando, FL (1987) Abstract.
Wollnik, H., and Casares, A., "An energy-isochronous multi-pass time-of-flight mass spectrometer consisting of two coaxial electrostatic mirrors", Int J Mass Spectrom 227:217-222 (2003).
D'Halloran, G.J., et al., "Determination of Chemical Species Prevalent in a Plasma Jet", Bendix Corp Report ASD-TDR-62-644, U.S. Air Force (1964). Abstract.
Examination Report for United Kingdom Application No. GB1618980.5 dated Jul. 25, 2019.
International Search Report and Written Opinion for International Application No. PCT/US2016/062174 dated Mar. 6, 2017, 8 pages.
IPRP PCT/US2016/062174 issued May 22, 2018, 6 pages.
Search Report for GB Application No. GB1520130.4 dated May 25, 2016.
International Search Report and Written Opinion for International Application No. PCT/US2016/062203 dated Mar. 3, 2017, 8 pages.
IPRP PCT/US2016/062203, issued May 22, 2018, 6 pages.
Search Report for GB Application No. GB1520134.6 dated May 26, 2016.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
IPRP for application PCT/US2016/063076, dated May 29, 2018, 7 pages.
Search Report for GB Application No. 1520540.4 dated May 24, 2016.
IPRP PCT/GB17/51981 dated Jan. 8, 2019, 7 pages.
IPRP for International application No. PCT/GB2018/051206, issued on Nov. 5, 2019, 7 pages.
International Search Report and Written Opinion for International Application No. PCT/GB2018/051206, dated Jul. 12, 2018, 9pages.
Examination Report under Section 18(3) for Application No. GB1906258.7, dated May 5, 2021, 4 pages.
Author unknown, "Electrostatic lens ," Wikipedia, Mar. 31, 2017 (Mar. 31, 2017), XP055518392, Retrieved from the Internet:URL: https://en.wikipedia.org/w/index.php?title=Electrostatic_lens&oldid=773161674 [retrieved on Oct. 24, 2018].
Hussein, O.A et al., "Study the most favorable shapes of electrostatic quadrupole doublet lenses", AIP Conference Proceedings, vol. 1815, Feb. 17, 2017 (Feb. 17, 2017), p. 110003.
Guan S., et al. "Stacked-ring electrostatic ion guide" Journal of the American Society for Mass Spectrometry, Elsevier Science Inc, 7(1):101-106 (1996). Abstract.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.

(56) References Cited

OTHER PUBLICATIONS

International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004) Abstract.
Yavor, M. I. "Planar Multireflection Time-Of-Flight Mass Analyser with Unlimited Mass Range" Institute for Analytical Instrucmentation RAS, Saint-Petersburg, (2004) Abstract.
Khasin, Y. I. et al. "Initial Experimenatl Studies of a Planar Multireflection Time-Of-Flight Mass Spectrometer" Institute for Analytical Instrucmentation RAS, Saint-Petersburg, (2004) Abstract.
Verenchicov., A. N. et al. "Stability of Ion Motion in Periodic Electrostatic Fields" Institute for Analytical Instrucmentation RAS, Saint-Petersburg, (2004) Abstract.
Verenchicov., A. N., "The Concept of Multireflecting Mass Spectrometer for Continuous Ion Sources" Institute for Analytical Instrucmentation RAS, Saint-Petersburg, (2006) Abstract.
Verenchicov., A. N., et al. "Accurate Mass Measurements for Inerpreting Spectra of atmospheric Pressure Ionization" Institute for Analytical Instrucmentation RAS, Saint-Petersburg, (2006) Abstract.
Kozlov, B. N. et al., "Experimental Studies of Space Charge Effects in Multireflecting Time-Of-Flight Mass Spectrometes" Institute for Analytical Instrucmentation RAS, Saint-Petersburg, (2006) Abstract.
Kozlov, B. N. et al., "Multireflecting Time-Of-Flight Mass Spectrometer With an Ion Trap Source" Institute for Analytical Instrucmentation RAS, Saint-Petersburg, (2006) Abstract.
Hasin, Y. I., et al., "Planar Time-Of-Flight Multireflecting Mass Spectrometer with an Orthogonal Ion Injection Out of Continuous Ion Sources" Institute for Analytical Instrucmentation RAS, Saint-Petersburg, (2006) Abstract.
Lutvinsky Y. I. et al., "Estimation of Capacity of High Resolution Mass Spectra for Analysis of Complex Mixtures" Institute for Analytical Instrucmentation RAS, Saint-Petersburg, (2006) Abstract.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
"Reflectron—Wikipedia", Oct. 9, 2015, Retrieved from the Internet: URL:https://en.wikipedia.org/w/index.php?t itle-Reflectron&oldid=684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/GB2020/050471, dated May 13, 2020, 9 pages.
Search Report for GB Application No. GB1903779.5, dated Sep. 20, 2019.
Search Report for GB Application No. GB2002768.6 dated Jul. 7, 2020.
Collision Frequency, https://en.wikipedia.org/wiki/Collision_frequency accessed Aug. 17, 2021.

* cited by examiner

GRIDLESS ION MIRRORS WITH SMOOTH FIELDS

CROSS-REFERENCE TO RELATED APPLICATIONS

This application is a U.S. national phase filing claiming the benefit of and priority to International Patent Application No. PCT/GB2019/051118, filed on Apr. 23, 2019, which claims priority from and the benefit of United Kingdom patent application No. 1806507.8 filed on Apr. 20, 2018. The entire contents of these applications are incorporated herein by reference.

FIELD OF THE INVENTION

The invention relates to the area of multi-reflecting time-of-flight mass spectrometers and electrostatic ion traps, and is particularly concerned with improved electric fields in gridless ion mirrors.

BACKGROUND

TOF-MS with ion mirrors: Time-of-flight mass spectrometers (TOF MS) are widely used for their combination of sensitivity and speed. An ion mirror with two stages separated by grids has been introduced by Mamyrin in SU198034. The mirror folds the ion trajectories and allows reaching second order time per energy focusing, this way improving mass resolving power of TOF MS. Since then, vast majority of TOF MS employ ion mirrors. To eliminate ion losses and ion scattering on grids, gridless (grid-free) ion mirrors with moderate ion optical quality were introduced in U.S. Pat. No. 4,731,532A.

Multi-reflecting TOF MS: Introduction of Multi-reflecting TOF (MRTOF) MS greatly improves resolution and mass accuracy of TOF MS. Resolution improves primarily due to substantial extension of ion path, say, L=20-50 m in MRTOF versus L=2-5 m of singly reflecting TOF. To fit a reasonable instrument size, the ion path is densely folded between gridless ion mirrors, where grids can not be used because of devastating ion losses at multiple grid passages, as described in SU1725289, U.S. Pat. Nos. 6,107,625, 6,570,152, GB2403063, U.S. Pat. No. 6,717,132, incorporated herein by reference.

E-Traps: As exampled by U.S. Pat. No. 6,744,042, WO2011086430, US2011180702 and WO2012116765, incorporated herein by reference, multi-reflecting analyzers are proposed for use as electrostatic ion traps (E-traps). Ions are trapped between ion mirrors, oscillate at a mass dependent frequency, and the oscillation frequency is recorded with image current detectors. WO2011107836 proposes an open trap—a hybrid between TOF and E-trap.

Ion Mirrors: Most of MRTOF and E-traps employ similar electrostatic analyzers composed of two parallel gridless ion mirrors, separated by a drift space. Coaxial gridless ion mirrors were introduced in H. Wollnik, A. Casares, Int. J. Mass Spectrom. 227 (2003) 217-222 while planar gridless ion mirrors with improved third-order energy isochronicity and second-order spatial isochronicity were introduced in GB2403063. Further improvements in WO2013063587 and WO2014142897 have brought the energy isochronicity to fifth-order and spatial isochronicity to full third-order, including cross terms on energy, angular and spatial spreads. It is of significant relevance that gridless ion mirrors of high ion-optical quality have been constructed of very few thick electrodes, either rings or frames to generate desired field distributions.

PCB ion mirrors: Since the 1980s, printed circuit board (PCB) technology was proposed for making electrodes and electrode assemblies for mass spectrometers, as exampled in U.S. Pat. Nos. 4,390,784, 4,855,595, 5,834,771, 5,994,695, 6,614,020, 6,580,070, 7,498,569, EP1566828, U.S. Pat. Nos. 6,316,768, 7,675,031 and 8,373,120, incorporated herein by reference. However, the field structures of those mirrors were copying known mirror designs and were concerned with the construction method rather than with improved fields. As far as is known, there were no PCB mirrors proposed with an improved ion optical quality of ion mirrors, matching or exceeding the ion optical quality of best thick electrode mirrors.

SUMMARY

The present invention provides an ion mirror for reflecting ions along an axis (X) comprising: a first axial segment (E2), within which the turning points of the ions are located in use, and a second axial segment (E3), wherein the first and second axial segments are adjacent each other in a direction along said axis (X); wherein at least the first axial segment comprises a plurality of electrodes that are spaced apart from each other along said axis (X), wherein the electrodes in at least the first axial segment have substantially the same lengths along said axis and adjacent pairs of these electrodes are spaced apart by substantially the same spacing such that these electrodes are arranged so as to have a pitch P along said axis; wherein said plurality of electrodes define windows arranged in a plane (Y-Z plane) orthogonal to said axis (X) through which the ions travel in use, wherein the windows have a minimum dimension H in said plane (Y-Z plane); and wherein $P \leq H/5$.

The mirror may have a first axial end for receiving ions into the ion mirror, and a second axial end that the ions travel towards and are then reflected back towards (and out of) the first axial end. The second axial segment may be arranged closer to said first axial end of the ion mirror (i.e. the entrance/exit end) than the first axial segment.

The mirror may comprise voltage supplies for applying different voltages to different electrodes of the ion mirror for generating electric fields for performing said reflecting of the ions. At least the first axial segment may be defined between inter-segment electrodes that are spaced apart along said axis, each of said inter-segment electrodes being an electrode to which one of said voltage supplies is connected to. Said plurality of electrodes in the first axial segment may be arranged between the inter-segment electrodes, and may be electrically connected thereto and interconnected with each other by electronic circuitry such that when the voltage supplies apply voltages to the inter-segment electrodes, this causes the plurality of electrodes to be maintained at different potentials so as to generate said electric fields.

The term "inter-segment electrodes" refers to the electrodes at the axial ends of each axial segment, such as between adjacent segments. The "knot" electrodes referred to elsewhere herein are embodiments of the inter-segment electrodes.

The inter-segment electrodes defining the first axial segment may be connected to voltage supplies such that they are supplied with first and second potentials respectively, wherein a mean potential of the first and second potentials may equal a mean energy $K_0$ of an ion to be reflected in the mirror divided by the charge q of that ion. This may ensure that the ions are reflected in the first axial segment.

The plurality of electrodes in the first axial segment may be interconnected to each other by a chain of resistors.

The chain of resistors may be configured to form a substantially linear potential gradient at and along the plurality of electrodes within the segment.

The electrodes at the axial ends of the plurality of electrodes in the first axial segment may be electrically connected to the adjacent inter-segment electrodes, e.g. via resistors, so that the application of the voltages to the inter-segment electrodes causes voltages to be applied to the plurality of electrodes.

This enables the number of voltage supplies to be reduced. The precision of the resistors described above may be set at 1% or better, e.g. to sustain an optimal simulated field strength ratio E2/E1.

The second axial segment may also be bounded by inter-segment electrodes and may comprise a plurality of electrodes between them. These plurality of electrodes may be connected to each other and to the inter-segment electrodes using resistors, as described above in relation to the first axial segment.

The mirror may be configured such that the distance (X3) along said axis from the mean ion turning point in the first axial segment to the inter-segment electrode nearer to the mirror entrance/exit is ≤2H; ≤1.5H; ≤1H; ≤0.5H; in the range 0.2H≤X3≤1.7H; or in the range 0.1H≤X3≤1H.

The distance may be 0.2H≤X3≤1.7H in the case of a mirror having planar symmetry or may be 0.1H≤X3≤1H in the case of a mirror having cylindrical mirror symmetry.

The mirror may comprise voltage supplies and be configured to apply electric potentials to the electrodes of the first axial segment for generating a first linear electric field of a first strength E2 within the first axial segment, and to apply electric potentials to electrodes of the second axial segment for generating a second linear electric field of a second strength E3 within the second axial segment; wherein the ratio of field strengths E3/E2 is related to the distance X3 by the relationship E3/E2=A*[0.75+0.05*exp ((4X3/H)−1)], where 0.5≤A≤2.

This relationship may be for ion mirror with planar symmetry.

The ratio E3/E2 may be one of the group: (i) 0.8≤E3/E2≤2 at 0.2≤X3/H≤1; (ii) 1.5≤E3/E2≤10 at 1≤X3/H≤1.5; and (iii) E3/E2≥10 at 1.5≤X3/H≤2.

The ion mirror may comprise a third axial segment arranged further from an entrance end of the ion mirror than the first axial segment. The mirror may comprise voltage supplies configured to apply electric potentials to the electrodes of the first axial segment for generating a first linear electric field of a first strength E2 within the first axial segment, and to apply electric potentials to electrodes of the third axial segment for generating a third linear electric field of a third strength E1 within the third axial segment; wherein E1<E2. The mirror may be configured such that the distance (X2) along said axis from the mean ion turning point within the first axial segment to the inter-segment electrode further from the mirror entrance is 0.2≤X2/H≤1.

The ion mirror may comprise voltage supplies and may be configured to apply electric potentials to the electrodes of the first axial segment for generating a first linear electric field (E2) of a first strength within the first axial segment, and to apply electric potentials to electrodes of the second axial segment for generating a second linear electric field (E3) of a second strength within the second axial segment; wherein the electrodes are configured such that the second linear electric field (E3) penetrates into the first axial segment so that the axial electric field in an axial portion of the first axial segment is non-linear where the turning points of the ions are located.

The axial electric field strength ($E_0$) at the mean ion turning point may therefore be slightly different to the first strength of the first linear electric field (E2).

The electric fields described above may be the axial electric fields along the central axis of the mirror (i.e. away from the electrodes).

An axial electric field strength $E_0$ at a mean ion turning point within the first axial segment may be related to the strength of the first linear electric field E2 by a relationship from the group comprising: (i) $0.01 \leq (E_0 - E2)/E2 \leq 0.1$; and (ii) $0.015 \leq (E_0 - E2)/E2 \leq 0.03$.

The electrodes may be configured such that the second linear electric field (E3) penetrates into the first axial segment so that the equipotential field lines in the first axial segment are curved where the turning points of the ions are located.

The different field strengths in said first and second axial segments may produce curved equipotential field lines in a transition region between the first and second axial segments.

Electrodes in the second axial segment may have substantially the same lengths along said axis and adjacent pairs of these electrodes may be spaced apart by substantially the same spacing such that these electrodes are arranged so as to have a pitch P along said axis. The plurality of electrodes may define windows in a plane (Y-Z plane) orthogonal to said axis (X) through which the ions travel in use, wherein the windows have a minimum dimension H in said plane (Y-Z plane). The ratio of said pitch to height may be given by P≤H/5.

Although two axial segments of the ion mirror have been described, the ion mirror may comprise more than two axial segments.

The mirror may comprise a third axial segment (E1) adjacent to the first axial segment (E2) in a direction along said axis (X); wherein the third axial segments comprises a plurality of electrodes that are spaced apart from each other along said axis (X).

The third axial segment may be arranged further from the first axial end of the ion mirror (the entrance end) than the first axial segment.

Electrodes in the third axial segment may have substantially the same lengths along said axis and adjacent pairs of these electrodes may be spaced apart by substantially the same spacing such that these electrodes are arranged so as to have a pitch P along said axis. The plurality of electrodes may define windows in a plane (Y-Z plane) orthogonal to said axis (X) through which the ions travel in use, wherein the windows have a minimum dimension H in said plane (Y-Z plane). The ratio of said pitch to height may be given by P≤H/5.

The mirror may comprise voltage supplies and may be configured to apply electric potentials to the electrodes of the third axial segment for generating a third linear electric field (E1) of a third strength within the third axial segment. The electrodes may be configured such that the third linear electric field (E1) penetrates into the first axial segment so that the axial electric field in an axial portion of the first axial segment is non-linear where the turning points of the ions are located.

The axial electric field strength ($E_0$) at the mean ion turning point may therefore be slightly different to the first strength of the first linear electric field (E2).

The length of the first axial segment along said axis may be ≤5H; ≤4H; ≤3H; or ≤2H.

Providing a relatively short first axial segment enables the electric fields from the adjacent axial segments to penetrate to the ion turning point.

The mirror may comprise voltage supplies and may be configured to apply electric potentials to the electrodes of the first axial segment for generating a first linear electric field (E2) of a first strength within the first axial segment, and to apply electric potentials to electrodes of the second axial segment for generating a second linear electric field (E3) of a second, different strength within the second axial segment; so as to form a non-uniform axial electric field at the boundary between the first and second axial segments.

The electrode windows described herein may have no mesh or grid electrodes located therein. The entirety of the ion mirror may have no mesh or grid electrodes located therein.

The plurality of electrodes (and inter-segment electrodes) may be apertured electrodes that have their apertures aligned along said axis, wherein the apertures are said windows. The apertures may be rectangular, circular or another shape. The apertures may have the same size and/or shape throughout the mirror.

Alternatively, each axial segment may comprise rows of electrodes, wherein the rows are spaced apart orthogonally to the axis of reflection. Each of these rows may comprise said plurality of electrodes that are spaced apart from each other along said axis. The electrodes in the rows define windows in a plane (Y-Z plane) orthogonal to said axis (X) through which the ions travel in use. The minimum dimension H of the windows in said plane (Y-Z plane) may correspond to the distance between the rows.

The mirror may have voltage supplies and be configured to apply electric potentials to the electrodes of the first axial segment for generating a first linear electric field of a first strength E2 within the first axial segment, wherein $4.3U_0/D<E2<5U_0/D$, where $U_0$ is equal to a mean energy $K_0$ of an ion to be reflected in the mirror divided by the charge q of that ion, and D is the distance from the mean ion turning point to a first order energy focusing time focal point of the mirror.

The mirror may be configured such that 15≤D/H≤25.

The mirror may comprise an entrance lens, the entrance lens optionally comprising one of the group: (i) an accelerating lens; (ii) a retarding lens; (iii) a multistage lens; (iv) a dual lens formed on both ends of an elongated lens electrode; and (v) an immersion lens.

The potentials and dimensions of the axial segments may be optimized per particular entrance lens to provide spatial ion focusing, for at least full second order spatial isochronicity and optionally high order time per energy isochronicity of the list: (i) at least third-order energy isochronicity; (ii) at least forth-order of energy isochronicity; (iii) at least fifth-order energy isochronicity; and (iv) at least sixth-order energy isochronicity. Small energy aberrations of particular order may be left at residual level for partial compensation of higher order aberrations.

The axial segments may be made using thin conductive electrodes, which may be either metal, carbon filled epoxy protrusion profiles, or conductive coated insulators. The electrodes may be attached to one or more insulating substrate, such as plastics, printed circuit boards (or PCB substrate), epoxy, ceramics, or quartz, or may be clamped with insulating spacers.

The positioning accuracy and straightness of the electrodes may be improved by either slots in the insulating substrates or by multiple connecting pins; or by using precision spacers, and/or by technological fixtures at electrode attachment to the substrate.

At least some of the electrodes of the ion mirror are conductive strips of a printed circuit board (PCB).

The PCB substrate may be made of either epoxy-based material, ceramics, quartz, glass, or Teflon.

The PCB may be provided with antistatic surface properties.

This may be provided by the residual conductance of the substrate, conductive lines on the substrate (other than the electrodes), by an antistatic or resistive coating on the substrate (e.g. of GOhm to TOhm range), or by maintaining the spacing between electrode strips as <1 mm.

An antistatic coating may be either deposited on top of or under the conductive strips. The antistatic coating may be produced by one of the group: (i) depositing onto a surface an insulator (e.g. polymer or metal oxide) coated with conductive particles; (ii) (thin) coating a surface with low conductance material such as SnO2, InO2, TiO2, or ZrO2; and (iii) exposing a surface to glow discharge at intermediate gas pressures with deposition of metal atoms or metal oxide molecules onto said PCB surface.

The mirror may comprise two parallel printed circuit boards that are spaced apart by said minimum dimension H, and which comprise said plurality of electrodes in the form of a periodic structure of conductive strips aligned on the PCBs orthogonal to said axis and with a period P≤H/5.

The strips may be interconnected by resistive chains as described above.

The inter-segment electrodes may be conductive strips on the PCBs. These inter-segment electrodes may form at least two or three axial segments, as described above.

The printed circuit board may be provided with antistatic properties by providing a periodic structure of parallel conductive lines between said conductive strips and/or an antistatic coating (e.g. with a resistance in the range from 1 GOhm/square to 10 TOhm/square).

The conductive strips may be curved in the plane of the PCB, optionally for forming trans-axial electric fields.

The axial segments may be formed with flexible printed circuit boards, e.g. such as either thin epoxy, Teflon, or Kapton based boards.

The topology of the ion mirror may be one of the group: (i) a 2D-planar mirror with slit windows; (ii) a 2D-circular mirror with ring windows; (iii) 2D-cylindrical mirror with electrodes arced around the Y-axis; and (iv) arc bent with circular Z-axis.

According to some embodiments, the electrodes in the first axial segment (and/or other axial segments) need not have the same lengths along the axis, and/or adjacent pairs of these electrodes may not be spaced apart by substantially the same spacing. Alternatively, or additionally, these electrodes may not have a pitch P along the axis that satisfies P≤H/5.

From another aspect, the present invention provides an ion mirror for reflecting ions along an axis (X) comprising: a first axial segment, within which the turning points of the ions are located in use, and a second axial segment, wherein the first and second axial segments are adjacent each other in a direction along said axis (X); and voltage supplies configured to apply electric potentials to electrodes of the first axial segment for generating a first linear electric field of a first strength within the first axial segment, and to apply electric potentials to electrodes of the second axial segment for generating a second linear electric field of a second strength within the second axial segment; wherein the voltage supplies and electrodes are configured such that the second linear electric field penetrates into the first axial segment so that the axial electric field in an axial portion of the first axial segment is non-linear where the turning points of the ions are located, and such that an axial electric field strength $E_0$ at a mean ion turning point within the first axial segment is related to the strength E2 of the first linear electric field by the relationship $0.01 \leq (E_0 - E2)/E2 \leq 0.1$.

The mirror according to this aspect may have any one, or combination, of the features described above and elsewhere herein.

For example, the relationship may be $0.015 \leq (E_0 - E2)/E2 \leq 0.03$.

From another aspect, the present invention provides an ion mirror for reflecting ions along an axis (X) comprising: an entrance end for receiving ions; a first axial segment (E2), within which the turning points of the ions are located in use, and a second axial segment (E3) adjacent the first axial segment in a direction along said axis (X); and voltage supplies for applying different voltages to different electrodes of the ion mirror for generating electric fields that perform said reflecting of the ions; wherein at least the first axial segment is defined between inter-segment electrodes that are spaced apart along said axis, each of said inter-segment electrodes being an electrode to which one of said voltage supplies is connected to, wherein the first axial segment comprises a plurality of electrodes spaced apart from each other along said axis (X) and arranged between the inter-segment electrodes, wherein the plurality of electrodes are electrically connected to the inter-segment electrodes and interconnected with each other by electronic circuitry such that when the voltage supplies apply voltages to the inter-segment electrodes, this causes the plurality of electrodes to be maintained at different potentials so as to generate said electric fields; wherein said plurality of electrodes define windows arranged in a plane (Y-Z plane) orthogonal to said axis (X) through which the ions travel in use, wherein the windows have a minimum dimension H in said plane (Y-Z plane); and wherein the mirror is configured such that the distance (X3) along said axis from a mean ion turning point within the first axial segment to the inter-segment electrode nearer to an entrance end of the mirror is selected from the group of: ≤2H; ≤1.5H; ≤1H; ≤0.5H; in the range $0.2H \leq X3 \leq 1.7H$; or in the range $0.1H \leq X3 \leq 1H$.

The mirror according to this aspect may have any one, or combination, of the features described above and elsewhere herein.

From another aspect, the present invention provides a mass spectrometer comprising: at least one ion mirror as described herein; an ion source for providing ions into the ion mirror; and an ion detector.

The mass spectrometer may be either: (i) a time of flight mass spectrometer, optionally a multi-reflecting time of flight mass spectrometer comprising two of said ion mirrors arranged to reflect ions between the ion mirrors multiple times; or (ii) an electrostatic trap mass spectrometer.

From another aspect, the present invention provides a method of mass spectrometry comprising: providing an ion mirror or spectrometer as described herein; supplying ions into said ion mirror; reflecting ions at ion turning points within said first axial segment (E2); and detecting the ions.

The method may be operated to perform any of the functions described herein.

Embodiments of the invention provide a particular range of ion optical designs of ion mirrors for reaching an unprecedented ion optical quality of gridless ion mirrors, found to provide mass resolving powers above 100,000 for an unusually wide energy spread—above 20%. This allows improving so-called turn-around time of ion packets by applying stronger extraction fields within ion sources for obtaining higher resolutions per flight path.

The improvement is based on a novel qualitative realization—energy acceptance of ion mirrors improves by using an ion reflecting field with a weak non-uniformity at the ion turning region, where a controlled slight curvature of the axial field distribution is achieved by penetration of an external field into an open region of an initially uniform field. A controlled and weak non-uniformity of the electric field allows keeping the flight time independent of the position of the ion turning point in a wide energy range while, by Laplace law, the non-linearity of the axial field also generates a spatial curvature of equipotential lines to improve time per spatial and angular aberrations.

Ion mirrors are then improved by constructing the entire ion mirror, or at least the ion mirror's reflecting part of open connected segments, having linear potential distributions on segment electrodes, i.e. each segment separately generating fundamentally uniform fields. Field penetration between segments generates slight field curvatures, while not generating strong oscillations of field strength and of higher field derivatives, unavoidable in prior art designs of gridless ion mirrors, constructed of thick electrodes. Embodiments of the invention provide a range of optimal geometries and conditions (sweet spot) to form the desired uniformity and slight controlled curvature of ion mirror fields. Preferred embodiments illustrate examples of such geometries and of such fields.

The approach perfectly falls into PCB methods of making ion mirrors, since generation of the linear field segments may be formed using narrow strip electrodes, energized via dividing resistive chains. Embodiments of the invention use PCB boards with conductive strips at the inner surface of ion mirrors. To avoid electrically charging the insulators, the inner surface may be coated by a resistive or antistatic coating, e.g. at GOhm to TOhm range, sufficing at moderate and technologically reasonable uniformity. Alternatively, substrate materials may be made with controlled impurities to generate a limited substrate conductance.

Novel mirror fields may be also formed with separate thin electrodes frames or electrode rods, interconnected by resistive chains, which is considered a less preferred method for reasons of higher making and assembly cost, however, reducing risks of substrate charging. To support parallelism of thin electrodes, embodiments of the invention provide a range of constructing methods and designs, such as aligning grooves or use of technological jigs at electrode assembly.

The proposed making methods pose an additional limitation by surface leakage. PCB and plastics start leaking at field strengths above 1 kV/mm and safe design requires keeping field strengths under 500V/mm, reduced to 300V/mm for ultra conservative design. Embodiments of the invention account for this limit at ion optical design and propose a subset of sweet spot geometries and conditions in forming high quality ion mirrors with uniform field segments.

Improved ion mirrors can be constructed of planar and cylindrical symmetry and are applicable for a range of isochronous electrostatic analyzers, such as electrostatic traps, open ion traps and TOF mass spectrometers. A planar version allows stacking multiple low cost mirrors into an array. Those arrays are proposed for improving duty cycle of orthogonal accelerator and for various multiplexing schemes, already known in mass spectrometry.

According to one aspect of the invention, within time-of-flight, or multi-reflecting time-of-flight, or isochronous electrostatic trap mass spectrometers, there is provided an isochronously reflecting gridless ion mirror comprising:

(a) within Cartesian XYZ coordinates, a set of parallel conductive electrodes having or forming mutually aligned windows oriented orthogonal to the ion reflection axis X to form a two dimensional electrostatic field in an XY plane; the characteristic smallest transverse size H of said windows is defined as either a window diameter for ring electrodes, or a smaller Y-dimension for rectangular windows;

(b) electrodes are grouped into at least two segments denoted as E2 and E3; wherein the segments E2 and E3 are adjacent and are separated by a "knot" electrode with an open window, not having mesh; wherein distinct potentials are applied to "knot" electrodes on segments boundaries; and wherein electrodes of each segment are interconnected with a uniform resistive chain to form a linear potential distribution on electrodes within segments with corresponding potential gradients E2 and E3 on electrodes; wherein the segment E3 is located upstream of the E2 segment, i.e. closer to the mirror exit;

(c) potentials U2 and U3, applied to "knot" electrodes surrounding the E2 segment, are chosen to contain the mean potential $U_0$, also defining the X-axis origin X=0: $U2>U_0>U3$, $U_0=K_0/q$, where $K_0$ is the mean ion energy and q is the ion charge, this way ensuring that the mean ion turning point is contained within the E2 segment;

(d) wherein said applied potentials are chosen to provide non equal potential gradients in the segment E2 and E3 to form a non uniform axial field at segments' boundary;

(e) at least in the E2 segment, the electrodes thickness and spacing in the X-direction are uniform and the spatial period P of electrodes is $P\leq H/5$;

(f) wherein to provide for advanced isochronous and spatially focusing properties at ion reflection, the mirror satisfies the following set of conditions:

(i) field strength E2 is $4.3U_0/D\leq E2\leq 5U_0/D$, where D is the distance from mean ion turning point to a first order energy focusing time focal point;

(ii) the distance X3 (in the positive X-direction from the ion turning point to the exit from the ion mirror) from the mean ion turning point (X=0; $U=U_0$) to the nearest downstream "knot" electrode plane is $0.2H\leq X3\leq 1.7H$ in case of the planar mirror symmetry and is $0.1H\leq X3\leq 1H$ in case of the cylindrical mirror symmetry;

(iii) the ratio of field strengths E3/E2 is linked to the X3 distance by the relation $E3/E2=A*[0.75+0.05*\exp((4X_T/H)-1)]$ for ion mirror with planar symmetry, where $0.5\leq A\leq 2$ to provide for a controlled non-linearity of axial field distribution, demonstrated to enhance the energy acceptance of the ion mirror.

Preferably, the ratio E3/E2 may be linked to the X3 distance as: (i) $0.8<E3/E2\leq 2$ at $0.2<X3/H\leq 1$; (ii) $1.5<E3/E2\leq 5$ at $1<X3/H\leq 1.5$; and (iii) $E3/E2>5$ at $1.5<X3/H\leq 2$. Preferably, said mirror may further comprise an E1 segment with a field strength E1, located upstream of said segment E2 (in the negative X-direction) and separated from the adjacent segment E2 by a "knot" electrode with an open window, not having mesh; wherein E1<E2; and wherein the distance |X2| from the mean ion turning point to the separating "knot" electrode may be $0.2\leq X2/H\leq 1$.

Preferably, in order to provide for a non-linearity of the axial field distribution at the mean ion turning point (X=0) and this way to enhance the energy acceptance of the ion mirror, the axial field strength $E_0$ at the mean ion turning point with X=0, $U=U_0$, and $E=E_0$ may be slightly different from the E2 potential gradient in the E2 segment, containing the mean ion turning point, occurring due to the field penetration of surrounding segments E1 and E3; wherein said field non linearity may be contained in one range of the group: (i) $0.01\leq(E_0-E2)/E2\leq 0.1$; and (ii) $0.015\leq(E_0-E2)/E2\leq 0.03$.

Preferably, $15\leq D/H\leq 25$.

Preferably, the mirror may further comprise an entrance lens, formed by either thick electrodes or by segments with uniform electric field on the walls; said entrance lens may comprise one of the group: (i) accelerating lens; (ii) retarding lens; (iii) a multistage lens; (iv) a dual lens formed on both ends of an elongated lens electrode; and (v) an immersion lens. Preferably, potentials and dimensions of said segments may be optimized per particular entrance lens to reach for spatial ion focusing, for at least full second order second order spatial isochronicity and high order time per energy isochronicity of the list: (i) at least third-order energy isochronicity; (ii) at least forth-order of energy isochronicity; (iii) at least fifth-order energy isochronicity; and (iv) at least sixth-order energy isochronicity; and wherein small energy aberrations of particular order may be left at residual level for partial compensation of higher order aberrations.

Preferably, the number of said connected power supplies may be reduced by using auxiliary resistors connected between said "knot" electrodes; wherein the precision of said auxiliary resistors is set at 0.1% or better to sustain optimal simulated field strength ratio E2/E1.

Preferably, said segments may be made as a stack of thin conductive electrodes, either metal, or carbon filled epoxy protrusion profiles, or conductive coated insulators; wherein said electrodes are either attached to side insulating plates—plastic, printed circuit boards, ceramics, or quartz, or clamped with insulating spacers; and wherein the positioning accuracy and straightness of the electrodes may be improved by either slots in the side insulating substrates or by multiple connecting pins to the mounting holes in the side insulating substrates or by using precision spacers for electrode clamping, and/or by technological fixtures at electrode attachment to the substrate.

Preferably, at least a portion of mirror electrodes may be conductive stripes on a printed circuit board; said boards being made of either epoxy-based material, ceramics, quartz, glass, or Teflon; and wherein the antistatic surface properties may be arranged either with residual conductance of the substrate or with antistatic or resistive coatings from GOhm to TOhm range, or by keeping spacing between stripes<1 mm.

According to another aspect of the invention, there is provided an ion mirror for reflecting ions in an X-direction, and comprising:

(a) two parallel printed circuit boards, aligned in an XZ plane and spaced in the orthogonal Y direction by distance H; said boards are formed on either epoxy, ceramic, glass, quartz, or glass substrate;

(b) wherein said printed circuit boards have periodic structure of conductive stripes aligned with the Z axis with a period P being less than H/5;

(c) wherein said stripes are interconnected by a uniform resistive chain and wherein individual potentials are applied to selected "knot" conductive stripes, forming boundaries and separating at least three segments of uniform potential gradient; wherein said potential gradients are different between said segments;

(d) wherein the X-length of an intermediate segment is less than 2H and wherein potentials U2 and U3 on the boundaries of this intermediate segment are chosen to contain mean ion specific energy $U_0$: $U2>U_0>U3$; and (e) wherein said printed circuit board has an antistatic feature formed either with periodic structure of parallel fine conductive lines between said conductive stripes and/or an antistatic coating with resistance in the range from 1 GOhm/square to 10 TOhm/square.

Preferably, said antistatic coating may be either deposited on top or under said conductive stripes; and wherein said antistatic coating may be produced by one of technology the group: (i) depositing into surface of insulator (polymer or metal oxide) coated conductive particles; (ii) thin coated with low conductance material such as SnO2, InO2, TiO2, or ZrO2; and (iii) exposed to glow discharge at intermediate gas pressures with deposition of metal atoms or metal oxide molecules onto said PCB surface.

Preferably, said conductive stripes are curved in the XZ plane to form trans-axial electric fields. Preferably, said ion segments may be formed with flexible printed circuit boards, either thin epoxy boards, or Teflon, or Kapton based boards, and wherein the topology of said ion mirror is one of the group: (i) 2D-planar with slit windows; (ii) 2D-circular with ring windows; (iii) 2D-cylindrical with electrodes arced around Y-axis; and (iv) arc bent with circular Z-axis.

According to another aspect of the invention, there is provided a multi-reflecting time-of-flight mass spectrometer with at least two ion mirrors comprising:

(a) at least two segments of uniform two-dimensional electric field in an XY-plane, formed within channels of equal height, merged and open to each other for mutual field penetration in the X-direction of ion reflection;

(b) wherein the ion energy, said segments dimensions and fields are chosen to provide for locating the ion turning point within said penetrating field and distant from the field boundary by less than N calibers of smallest channel transverse dimension H; and (c) wherein N is one of the group: (i) $N\leq 2$; (ii) $N\leq 1.5$; (iii) $N\leq 1$; and (iv) $N\leq 0.5$.

Preferably, the spectrometer may further comprise one mean of isochronous ion packet focusing in the Z-direction of the group: (i) a trans-axial lens in front of the said mirror stack; (ii) a trans-axial lens arranged within said ion mirrors; (iii) an electrostatic wedge at ion reflection region of said ion mirror for compensating time-of-flight per spatial aberrations by any spatial focusing means.

Preferably, said at least two ion mirrors may be configured into two arrays of ion mirrors, mutually shifted in the Y direction for arranging ion trajectory shift in the Y-direction for every ion reflection within said ion mirror arrays.

According to the another aspect of the invention, there is provided a method of forming electrostatic field of isochronous ion mirror comprising the following steps:

(a) forming open and adjacent segments with uniform electrostatic field;

(b) forming different field strength in said segments to produce mutual field penetration and curvature of equipotential lines in transition regions between segments;

(c) arranging ion energy and field strength and lengths so that the ion turning point appears in a segment E2, and wherein for the purpose of high quality isochronicity and wide spatial acceptance of said reflecting field, the field penetration of at least one adjacent segment is arranged for the field $E_0$ at ion reflecting point deviating from the field strength E2 in one range of the group: (i) $0.01\leq(E_0-E2)/E2\leq 0.1$; (ii) $0.015\leq(E_0-E2)/E2\leq 0.03$.

BRIEF DESCRIPTION OF THE DRAWINGS

Various embodiments will now be described, by way of example only, and with reference to the accompanying drawings in which.

DETAILED DESCRIPTION

Figure 1:
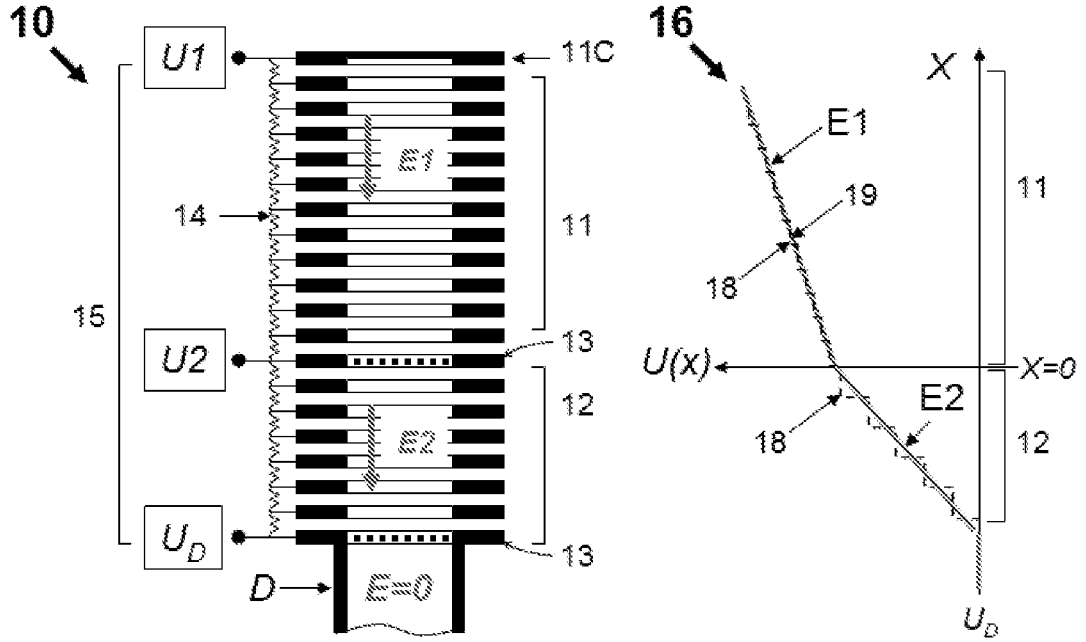
Fig.1 Prior Art
FIG. 1 shows a prior art grid-covered ion mirror of SU198034 for singly reflecting time-of-flight (TOF) mass analyzer.

Prior Art Ion Mirrors: Referring to FIG. 1, prior art grid-covered ion mirror 10 of SU198034 comprises: two mirror segments 11 and 12 (also referred as stages), formed by equal size ring electrodes; an upper cap electrode 11C; "knot" electrodes 13 with fine meshes to separate regions 11 and 12 of different uniform fields E1 and E2; power supplies 15—U1, U2 and $U_D$, connected to electrodes 13 and 11C; and a resistive chain 14 for linear potential distribution in electrode segments 11 and 12.

Mirror 10 forms uniform electric fields E1 and E2 in the core volume of segments 11 and 12 without distorting field-free (E=0) conditions in the drift space D. Plot 16 shows potential distributions: 18—at electrodes and 19—at the mirror axis. Small steps of voltage between individual electrodes appear well smoothed at sufficient distance from electrodes, usually considered equal to a spatial period of the electrode structure. To provide for second order time per energy focusing, there exists an optimal ratio of field strength E1 and E2, which depends on the segments length. In case of ultimately short stage 12, U2 is ⅔ of the ion mean specific energy per charge. As known in TOF MS field, with elongation of the stage 12, the ratio of the field strengths E2/E1 varies form E2/E1>>1 to about E2/E1=1, while reducing the ion on mesh scattering at the price of gradual reduction of the energy acceptance. The grid-covered mirror 10 has an exceptional spatial acceptance, i.e. may operate with very wide ion packets. However, if used for multi-reflecting TOF, ion passages through mesh cause devastating ion losses.

Figure 2:
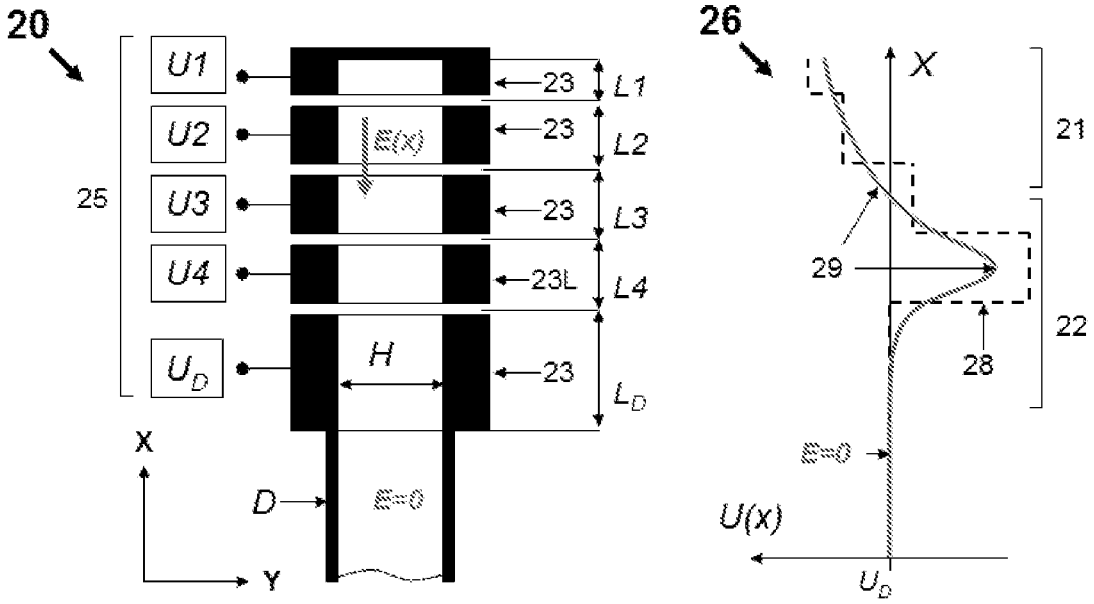
Fig.2 Prior Art
FIG. 2 shows a prior art gridless ion mirror of GB2403063 for multi-reflecting TOF (MRTOF) mass analyzer.

Referring to FIG. 2, prior art gridless (grid free) ion mirror 20 of GB2403063 is designed for multi-reflecting TOF (MRTOF) MS. Mirror 20 comprises: a set of thick rectangular frame electrodes 23 and 23L with the window height H (in the Y-direction, corresponding to narrower dimension of electrode window) being comparable to electrodes thicknesses from L1 to $L_D$; and a set of power supplies 25, connected to individual electrodes, denoted as U1 to U4 and $U_D$, where $U_D$ also defines the potential of the drift space D. Plot 26 shows potential distributions: 28—near electrodes and 29—at the mirror axis. In spite of large electrode thicknesses, comparable to H, ion optical optimization of electric fields allows reaching high order isochronicity—up to fifth-order energy isochronicity (compare to second order in mirror 10) and full third-order isochronicity, including spatial, angular, and energy, both—pure and mixed term aberrations, as described in WO2013063587 and WO2014142897. Those enhanced gridless ion mirrors provide for excellent isochronicity at reasonable spatial, angular and energy acceptances simultaneously with spatial and angular ion focusing. High-order isochronicity has been obtained with one key feature of gridless ion mirrors—an attractive (accelerating) ion lens 23L is arranged by setting U4 at more attractive potential compared to the drift potential $U_D$. Disadvantages of ion mirrors 20 are: high making cost; tight requirements on electrode straightness; wide fringing fields; and moderate energy acceptance.

Figure 3:
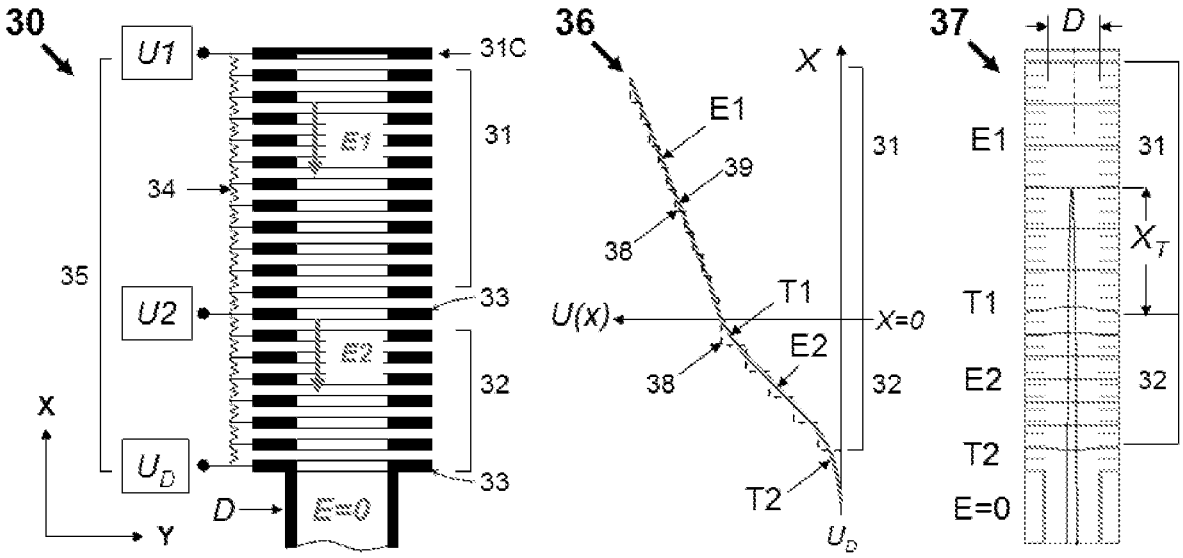
Fig.3 Prior Art
FIG. 3 shows a prior art gridless ion mirror of U.S. Pat. No. 6,384,410 for a singly reflecting TOF and shows ion optical properties of the ion mirror.
Figure 3:
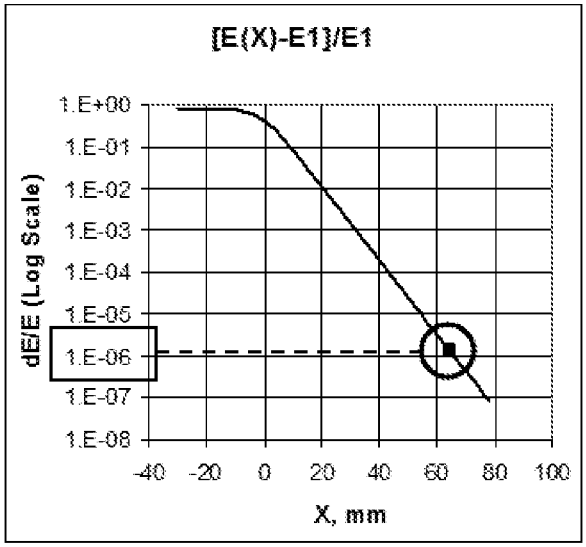
Fig.3 Prior Art
Figure 3:
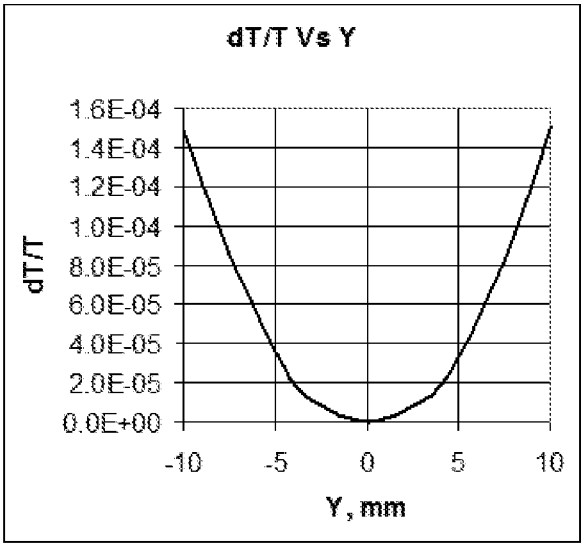
Fig.3 Prior Art

Referring to FIG. 3, prior art gridless (i.e. grid free) ion mirror 30 of U.S. Pat. No. 6,384,410 is a copy of the gridded mirror 10 of FIG. 1 with one difference—removing grids. Mirror 30 comprises: two mirror segments 31 and 32 (also referred as stages), formed by thin ring electrodes and an upper cap electrode 31C; boundary "knot" electrodes 33 (not having meshes!), separating regions of voltage gradient on electrodes between segments 31, 32, and field-free drift stage D; a resistive chain 34 for creating linear potential distribution at electrodes of segments 31 and 32; and power supplies 35—U1, U2 and $U_D$, connected to the electrodes 33 and 31C. The mirror forms uniform electric fields E1 and E2 in the inner volume of segments 11 and 12, however, distinctly from FIG. 1, also having transition fields T1 and T2 at segment boundaries. Plot 36 shows potential distributions: 38—at electrodes and 39—at the mirror axis. Small steps of voltages between individual electrodes appear well smoothed at the mirror axis. U.S. Pat. No. 6,384,410 proposes optimal ratio E2/E1≅2, and a highly uniform field at ion turning point, placed deep inside the segment 31.

U.S. Pat. No. 6,384,410 provides a numerical example for dimensions and voltages. We analyzed the ion optical properties of the exemplary mirror 37, as illustrated by shape of electrodes and equi-potential lines. The mirror provides for second-order time per energy focusing and allows 7% energy acceptance at 1E-5 level of time isochronicity. The design compensates for spatial focusing/defocusing of transition fields T1 and T2 (as stated in U.S. Pat. No. 6,384,410), thus, returning a non-diverging ion beam, which may be expressed as Y|Y=1. However, it does not focus initially diverging ion packets and generates a substantial second order time per space aberration T|YY, limiting packets width under 5 mm and angular divergence under 5 mrad for dT/T≤1E-5. Both shortages—absence of angular focusing and very small spatial acceptance do compromise use of mirror 30 for multi-reflecting TOF and E-traps.

The reflecting field E1 in the segment 31 may be highly uniform at the ion turning region, far-spaced from the "knot" electrode 33 by distance $X_T$, which is specifically stressed in U.S. Pat. No. 6,384,410. Simulations of the numerical example 37 have confirmed that the field E1 penetrates at 1E-6 level only at the ion turning point $X_T$=2.5D, where D is the electrode window diameter D=25 mm. The uniform field in the vicinity of the ion turning point strongly compromises the energy acceptance of ion mirrors. Besides, by nature of electric fields, highly uniform reflecting fields have no curvature of reflecting equipotential lines, thus, not providing for any means to improve the spatial isochronicity. As known in the field of ion optics, lenses always produce positive T|YY aberrations. Mirror 30 forms lens with T1 and T2 fields but has no means for compensating their time per space aberrations. If adding spatial focusing features to mirror 31 (say by making entrance lens T2 stronger), those time aberrations would increase further. Thus, the ion mirror 30 has low ion optical quality, not suitable for multi-reflecting TOF mass spectrometers and electrostatic traps.

Embodiments of the present invention improve the ion optical quality, the design and manufacturing technology of gridless ion mirrors, e.g. for MRTOF and E-Traps.

Principles of novel ion mirrors: Improved ion mirrors for Multi-reflecting TOF (MRTOF) and E-traps mass spectrometers according to embodiments of the invention shall be free of grids, shall provide spatial ion focusing, and shall be highly isochronous at wide energy and spatial acceptances.

Here we state that the ideal reflecting field near the ion turning point should have an optimal non-linearity of the field profile E(x) and a curvature of equi-potential lines, caused by the E(x) non-linearity to provide for two features of high quality ion mirrors: (A) compensation or minimizing of high-order time per energy aberrations; and (B) compensation of time per spatial spread aberrations. The weakly inhomogeneous field strength distribution in the area of the ion turning point leads to much better independence of the flight time with respect to energy, than both purely homogeneous and highly inhomogeneous fields of gridless ion mirrors.

The inventor has found that the quality of ion mirrors can be improved compared to the prior art by merging open regions of uniform fields, where mutual field penetration between segments allows the production of a monotonous and nearly uniform reflecting field at the ion turning point, with a controlled optimal non-linearity (of few percent) in order to provide for high order energy focusing and wider energy acceptance, also accompanied by providing spatial isochronicity. For yet better ion optical quality, the length of the ion reflecting segment shall be limited to allow for a sufficient field penetration from both ends, this way maximizing the energy acceptance.

Figure 4:
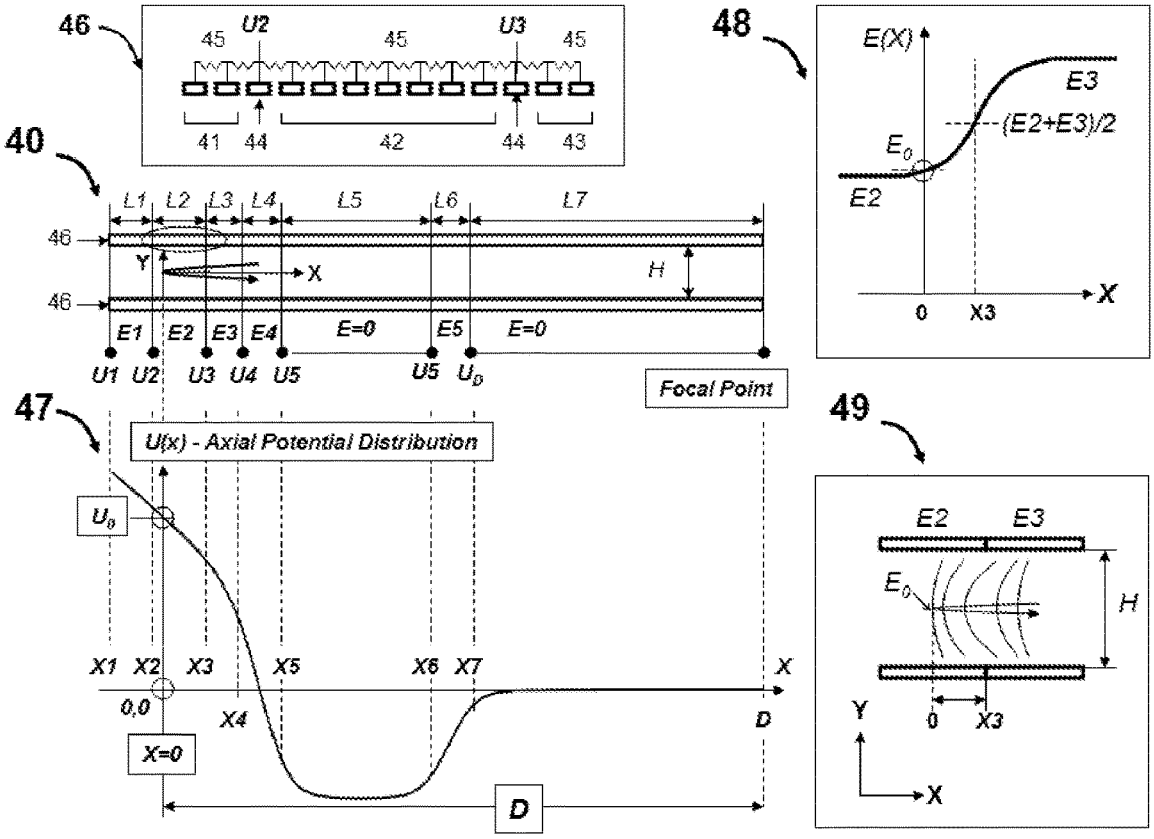
FIG. 4 illustrates the method and the design of improved ion mirrors of embodiments of the present invention, based on merging of open and gridless segments with linear potential distribution for providing a slight and controlled non-linearity and equipotential curvature in the ion reflecting region by mutual field penetration between the segments.

Referring to FIG. 4, one embodiment of an ion mirror 40 of the present invention comprises two parallel and identical rows 46 spaced by distance H. Each row 46 comprises a plurality of thin (<<H) conductive electrodes that are spaced apart along the X-axis. Schematic 40 shows an enlarged view of the portion of row 46 that is circled in schematic 40. Individual potentials U1, U2, U3 etc. are applied to different ones of the spaced apart electrodes. These electrodes are referred to herein as "knot" electrodes 44 (or inter-segment electrodes), and they define the axial boundaries of the axial segments 41, 42, 43 etc of the ion mirror. Each axial segment comprises a plurality of the electrodes arranged between the "knot" (or inter-segment) electrodes. These plurality of electrodes are interconnected with each other by resistive chains 45, and the electrodes at the axial ends are connected to the adjacent "knot" electrodes by the resistive chain. As such, when potentials U1, U2, U3 etc. are applied to the "knot" electrodes 44, this causes potentials to be applied to the plurality of electrodes therebetween. The structure thus forms a set of openly merged axial segments 41, 42, 43 etc with individual linear field strengths E1, E2 E3 etc along the electrode row 46. The electrodes may have substantially the same lengths along the X-axis and every adjacent pair of these electrodes may be spaced apart by substantially the same spacing such that these electrodes are spatially arranged at a certain pitch P along the X-axis.

The axial segments described herein may be denoted by their fields Ei.

The structure of openly merged segments 41,42,43 etc. forms potential distribution U(x) 47 at the mirror symmetry axis (at Y=0, i.e. away from the electrodes) with nearly uniform fields in the axially central part of individual segments, and with transition fields at segment boundaries. The potential distribution 47 is characterized by an accelerating lens around the segment E5 for spatial ion focusing in the Y-direction, so as by a reflecting field in segments E1 to E4 to provide for isochronous ion reflection in the X-direction.

Alternative electrode structures may be used to generate the same structure of electrostatic field. Those structures may comprise a set of thin electrodes with rectangular or circular windows, a pair of parallel printed circuit boards (planar ceramic, epoxy or Teflon PCB, or a flexible kapton PCB, rolled into a cylinder) with conductive stripes and with high-Ohmic antistatic coating, a pair of resistive plates (or a cylinder) with conductive stripes for knot electrodes, or an insulating (planar or cylindrical) support with resistive coating, separated into segments by conductive stripes. While understanding that multiple known technologies may be used to form the desired fine electrode structure, embodiments of the invention are primarily concerned with the properties of the desired electrostatic field itself to form the optimal non linearity 48 and the optimal curvature 49 of the electrostatic field near the ion turning region.

The ion mean turning point is defined by the potential $U=U_0=K_0/q$ at the mirror axis, corresponding to the full stop of ions with mean kinetic energy $K_0$ and charge q. In the embodiment 40, let us distinguish one core segment (a first axial segment 42) with the field E2, wherein ions of mean energy are turned: $U2>U_0>U3$. An important feature of embodiments of the present invention is the controlled penetration of surrounding uniform fields E1 and E3 (from second and third axial segments 41,43) into the E2 segment (42) and particularly to the location of the ion turning point (at X=0). As we found at ion optical modeling, the ion optical quality of the ion mirrors may be improved due to the penetration of the E3 field (from the second axial segment 43) into the E2 segment (42) to the location of the ion turning point. This provides for both: (a) slight and controlled non-linearity of E(x) curve as shown in icon 48; and (b) spatial curvature of equipotential lines in the region, surrounding the ion turning point at optimal X=0, as shown in the icon 49. Both non-linearity 48 and curvature 49 are mutually related by the nature of electrostatic fields. The optimal penetration of the E3 field corresponds to approximately 1-3% of E(x) variation=$(E_0-E2)/E2$. In other words, the penetration of fields into the E2 segment (42) to the location of the ion turning point (X=0) may cause the field at that point $E_0$ to differ from E2 by approximately 1-3% of E2. Allowing penetration of yet another field E1 (from the third axial segment 41) into the E2 segment (42) to the location of the ion turning region allows further improvement of the ion optical quality and provides for higher flexibility of controlling the field non-linearity in the E2 segment. Accordingly, the E1 and/or E3 field may be caused to penetrate to the ion turning region.

Figure 5:
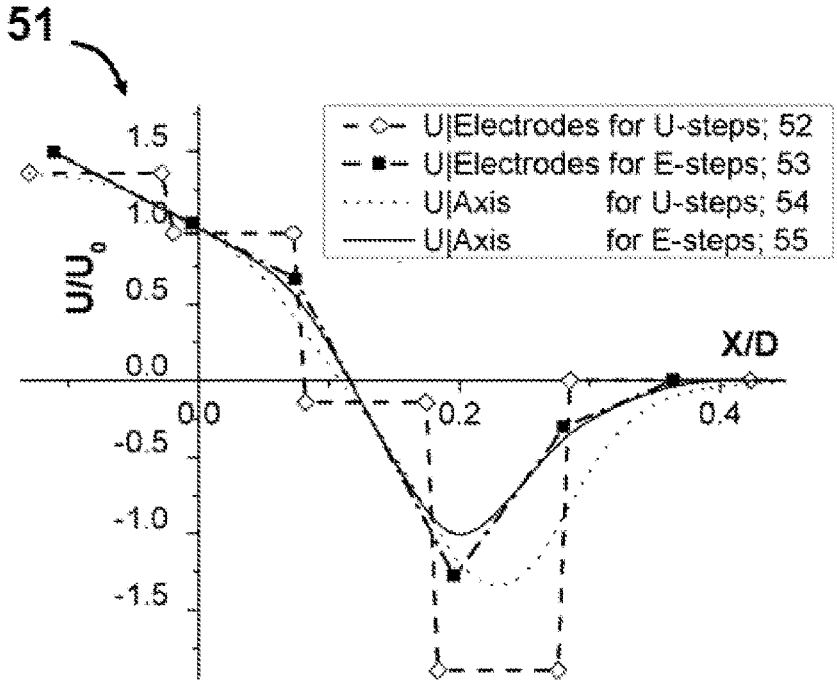
FIG. 5 presents axial and on-wall potential distributions for two ion mirrors, where the novel ion mirrors composed of uniform field segments is compared to conventional gridless ion mirror composed of thick electrodes.

Comparing novel and prior art gridless mirrors: Referring to FIG. 5, field distributions are compared between the prior art mirror 20 of FIG. 2 and the exemplary novel ion mirror 40 of FIG. 4. Individual thick electrodes of the mirror 20 define a stepped potential (U-steps) distribution 52 on electrode walls, smoothed at the axis to the axial distribution 54 by nature of electrostatic fields. Segmented linear potential distribution 53, forming steps of the field strength E (E-steps) on electrodes of the mirror 40 according to the embodiments, provides a closer initial approximation to the axial distribution 55, thus, forming smoother axial distribution 55.

The difference between axial distributions 54 and 55 is barely visible on a crude scale. However, let us highlight one difference: the axial potential distribution 55 of ion mirrors 40 according to embodiments is much more linear near the ion turning point at $U/U_0=1$, i.e. field strength variations $E/E_0$ at the ion turning point are much smaller and more monotonic as compared to prior art mirrors 20 constructed of thick electrodes.

Figure 6:
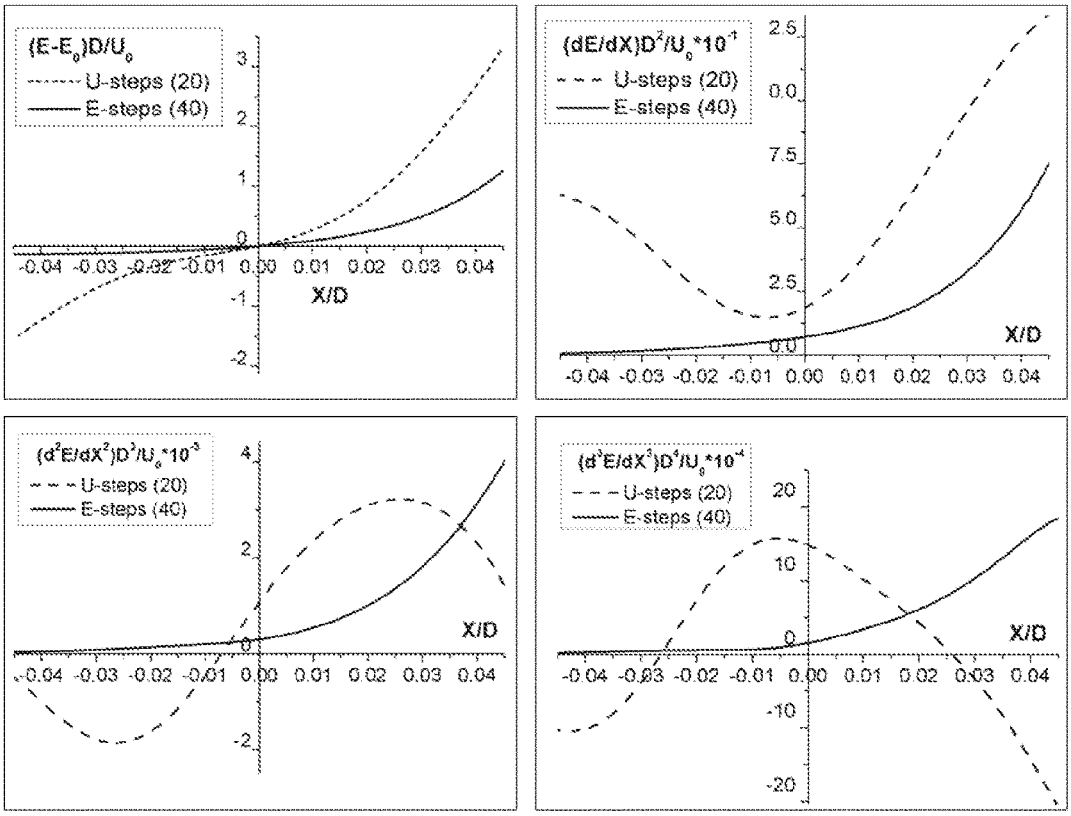
FIG. 6 compares axial distributions of field strength and higher field derivatives between mirrors of FIG. 5 to demonstrate smoother fields and smaller field variations in novel ion mirrors.

Referring to FIG. 6, the above described difference between the axial U(x) distributions 54 and 55 of mirrors 20 and 40 becomes more apparent when looking at higher order derivatives of the potential distribution U(x)–field strength E(X)=dU/dX, first dE/dX, second $d^2E/dX^2$ and third $d^3E/dX^3$ field derivatives, normalized to specific (to charge) mean ion energy $U_0$ and to the distance D from the ion turning point to the time-focal point (D is shown in FIG. 4). Dashed lines correspond to prior art mirror 20 composed of thick electrodes, generating steps of wall potential, denoted as U-step in the drawing. Solid lines correspond to segmented linear potential distributions obtained in the mirror 40 according to embodiments of the invention, and denoted as E-steps in the drawing. As apparent from the graphs, stepped E of novel mirror 40 provides smaller variations of field strength $E/E_0$ around the ion turning point at X=0, so as to achieve monotonous and much smoother distributions of higher field derivatives compared to the prior art stepped U mirror 20.

Figure 7A:
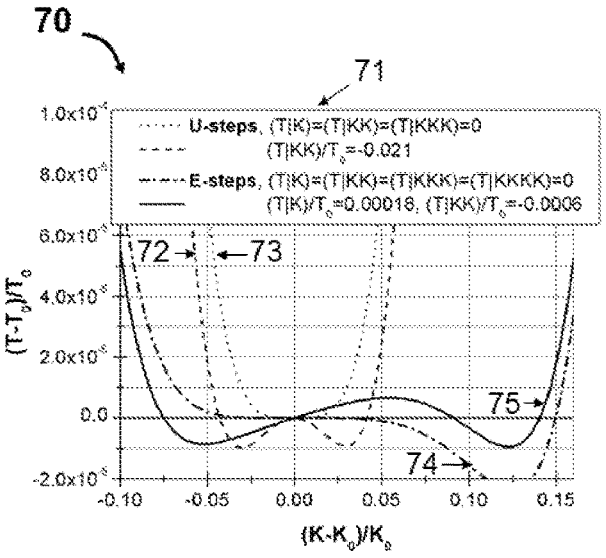
FIG. 7A compares time per energy curves between novel ion mirrors, composed of uniform field segments, and conventional gridless mirrors, composed of thick electrodes and shows substantial improvement of energy acceptance in novel ion mirror.

Referring to FIG. 7A, plot 71 compares flight time per ion energy curves $(T-T_0)/T_0$ Vs $(K-K_0)/K_0$ for prior art mirror 20 with a stepped wall potential (Step U) and for the ion mirror 40 of embodiments with a stepped field strength (step E) on electrodes, as denoted on the legend 71. The curve 72 for stepped U corresponds to the third-order time per energy focusing with ΔK=6% energy acceptance at 1E-5 level of isochronicity. The curve 74 for stepped E corresponds to the forth-order time per energy focusing with ΔK=14% energy acceptance at 1E-5 level of isochronicity. Fine tuning of mirrors potentials allows leaving minor residual coefficients for lower order time per energy aberration (shown in the figure legend 71) in order to reach a wider energy acceptance, as shown by curves 73 for stepped U and 75 for stepped E. Then the mirror 20 with stepped U provides for ΔK=9% energy acceptance, while the mirror 40 provides for a larger ΔK=22.5% energy acceptance. Thus, the ion mirror of the embodiments with stepped field strength E provides for substantially (2.5 times) wider energy acceptance. Experts in TOF MS are aware that the energy acceptance of a TOF analyzer limits the maximal usable field strength in accelerators, in turn limiting the minimal achieved turn around time, currently being the major limit for resolution in TOF MS. Thus, wider energy acceptance nearly directly translates into resolutions per flight path in MRTOF, where novel ion mirrors are expected to gain 2.5 fold higher resolution per flight path.

Figure 7B:
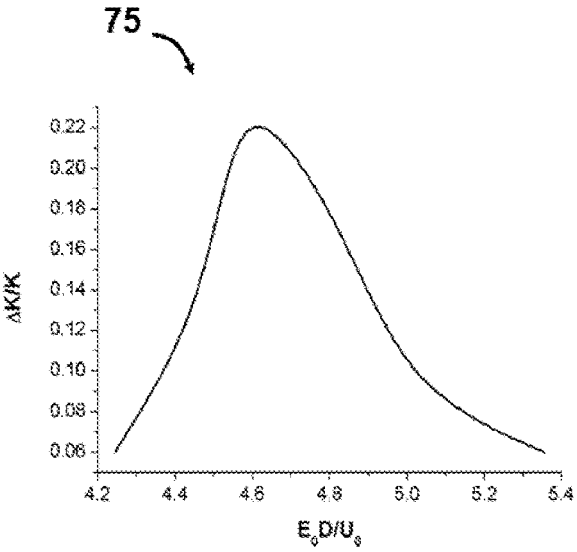
FIG. 7B plots energy acceptance of novel ion mirror as a function of normalized field strength at ion mean turning point and illustrates the need for accurate choice of field parameters for reaching high energy acceptances.

Referring to FIG. 7B, plot 75 presents energy acceptance ΔK/K at 1E-5 level of isochronicity as a function of normalized field strength $E_0D/U_0$ at ion mean turning point with X=0, $E=E_0$, and $U=U_0$, using annotations of FIG. 4. Optimum is observed within about +/−1% of $E_0D/U_0$ variation. Thus, ion mirrors 40, built of segmented fields, notably improve energy acceptance ΔK/K, however, their field structure and parameters shall be accurately set and controlled. Embodiments of the invention provide a combination of segmented fields with optimal "sweet spot" mirror parameters.

Referring back to FIG. 6, let us relate the obtained improvement of energy acceptance in FIG. 7 to the field structure of FIG. 6 to offer an intuitive explanation. Steps of wall potential (U step in FIG. 6) within prior art thick electrode ion mirror 20 allow reaching the desired field properties and compensating multiple time aberrations in the close vicinity of the ion mean turning point at X=0, as witnessed by curve 72 in FIG. 7. This is achieved by the optimized and adjusted field penetration from thick electrodes, surrounding the ion turning point at X=0 and $U=U_0$. However, by fields nature, such penetration of stepped U produce larger field variations and non monotonous higher field derivatives in a somewhat wider region around the turning point, thus, not sustaining the desired ion optical properties for wider energy spreads of ion packets, corresponding to longer spans of ion turning points. In contrast, the ion mirror 40 according to embodiments of the invention with a stepped field strength E on the wall generates an initially constant field strength $E \cong E_0$ in the wider vicinity of ion turning point X=0, while field penetration from surrounding field segments allows adding a desired and optimal degree of the field non uniformity and curvature of equipotential lines, thus, providing for a wider spatial span of ion reflecting points, where time aberrations are compensated, this way providing for a wider energy acceptance of ion mirror.

Optimizing novel mirrors: To accelerate the analysis and the optimization of ion mirrors according to embodiments of the invention, the inventor came up with an analytical expression for the axial distribution of the electric field E(x) in the planar two-dimensional gap with height H, where two segments with the field strengths E1 and E2 are openly merged at X=0:

$$E(x)=E1+(E2-E1)*(2/\pi)*\arctan(\exp[-\pi*x/H])$$

At |X/H|>0.1 the expression may be approximated by:

$$E(x)=E1+(E2-E1)*(2/\pi)*\exp(-\pi X/H)*[1+\tfrac{1}{3}*\exp(-2\pi X/H)+\tfrac{1}{3}*\exp(-4\pi X/H)]$$

Having an analytical expression strongly accelerates ion optical simulations and optimization procedures. Now we could vary parameters—channel height H, segments lengths Li and segments field strengths Ei at the walls, while optimizing a large set of low-order and high-order time and spatial aberrations for a variety of mirror systems which differ by the entrance lenses.

Optimization criteria: In optimization procedure we were setting acceptance criteria, comprising: spatial ion focusing (Y|Y=0 per one reflection); at least third-order time per energy (T|K=T|KK=T|KKK=0) focusing with low or zero higher order time per energy terms; full compensation of at least second-order time per spatial, angular and energy aberrations, including cross terms; and wider spatial and angular acceptances of model ion mirrors at about 1E-5 level of isochronicity.

Variety of novel mirrors: To provide for spatial ion focusing, the mirrors according to embodiments of the invention may have an entrance lens, preferably at an attracting potential $|U_L|<|U_D|$, which can be either a single stage lens or a multi-stage lens, or an immersion lens. The entrance lens part can be formed either with stepped field segments of thick electrodes. The reflecting fields of mirrors according to embodiments of the invention were constructed with segmented fields (stepped E) and were individually optimized per specific entrance lens. Varying the lens part of the ion mirror leads to minor adjustments of the mirror reflecting part if optimizing those ion mirrors for lowest aberrations and highest energy acceptances.

Figure 8:
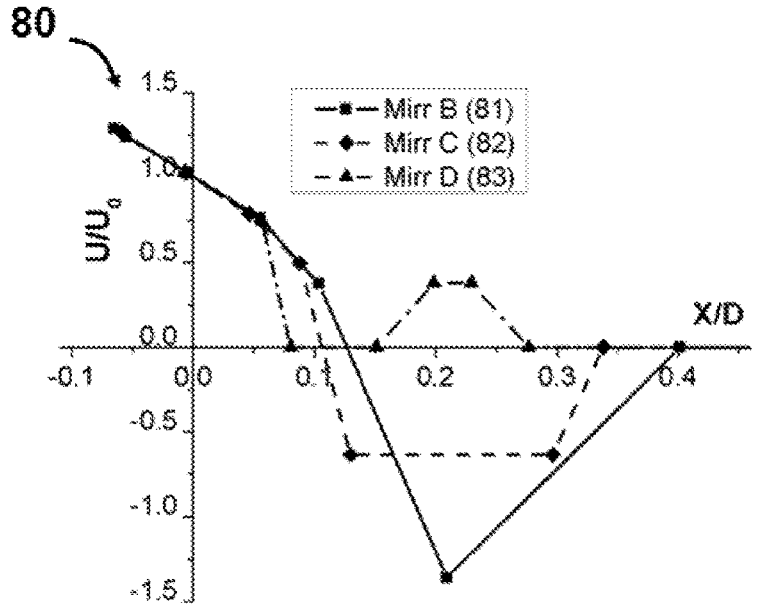
FIG. 8 shows on-wall potential distributions for three novel ion mirrors, different by their lens part.

Referring to FIG. 8, diagram 80 presents potential distributions $(U/U_0)$ Vs X/D at electrode walls for another three variants of ion mirrors according to embodiments of the invention with stepped field (step E) reflecting parts. Plot 81 corresponds to an ion mirror with accelerating lens formed with segmented fields (stepped E), 82—with a long accelerating lens, formed with thick electrodes (stepped U), and 83—with a decelerating lens, formed with segmented fields (stepped E). Obviously, the two field segments, denoted by their fields E1 and E2 in the reflecting part of ion mirrors are quite similar for all three variants.

Table of comparison of ion-optical parameters of E-Steps and T-Steps mirrors.

| | U-steps, Mirr 20 | E-steps, Mirr 40 | E-steps, MirrB |
|---|---|---|---|
| $(T\|KKKK)/T_0$ | 11.5 | 0 | 0 |
| $(T\|KKKKK)/T_0$ | 8.7 | −4.67 | −7.70 |
| $(T\|KKKKKK)/T_0$ | 116.7 | 31.2 | 45.9 |
| $(T\|BBK)/T_0$ | 6.4 | 13.3 | 9.7 |
| Acceptance ΔK/K at $\Delta T/T_0$ = ±1E−5 | 6% | 16% | 14% |
| Aberration corrected ΔK/K | 9% | 22% | 17% |
| ΔB, mrad, at [(T\|BBK)/T0]* $B^2(\Delta K/K/2)$ = 1E−5 | 14.4 | 5.35 | 6.97 |

Figure 9A:
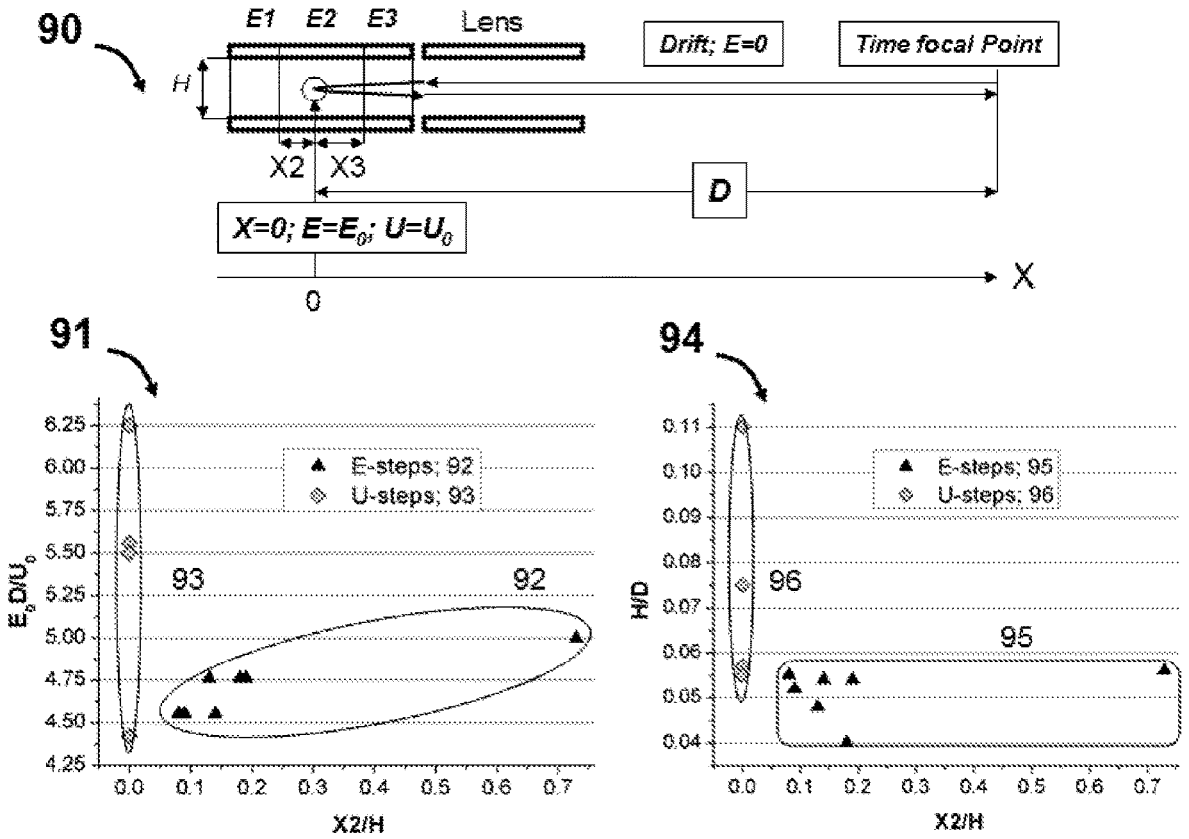
FIG. 9A annotates physical parameters and field parameters for jet wider (relative to FIG. 8) variety of optimized novel ion mirrors, different by lens part; it also presents the range of "sweet spot" parameters for those optimized novel gridless ion mirrors.
Figure 9B:
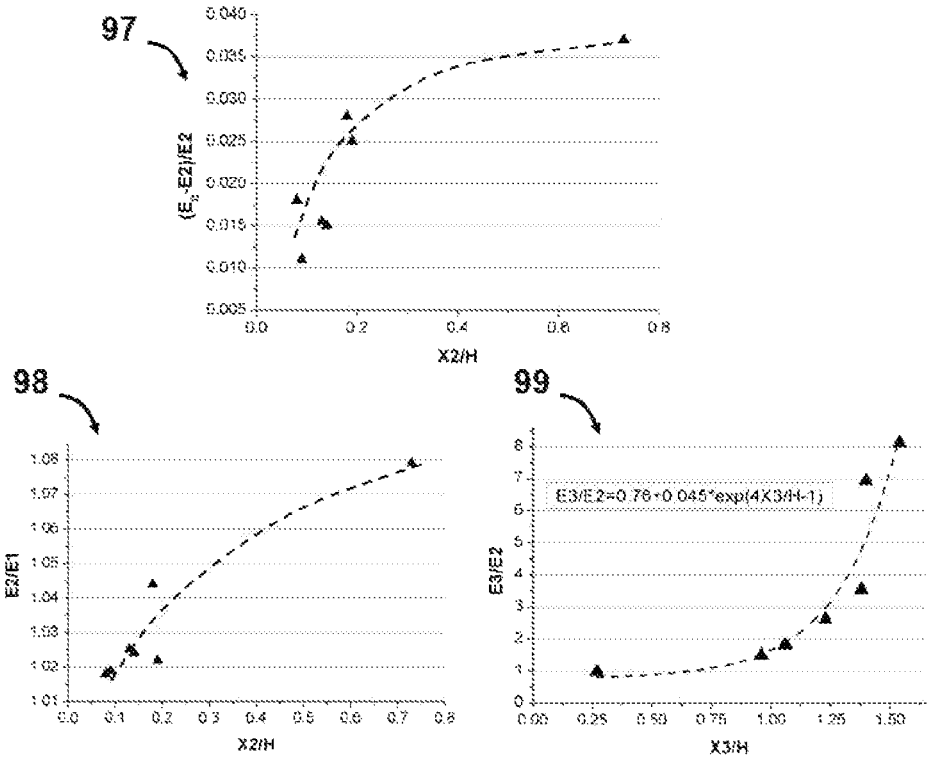
FIG. 9B for the same set of simulated ion mirrors as in FIG. 9A, shows the optimal range of electric field non-linearity at ion turning point and presents the link between strength and depth of penetrating fields.

Sweet spot: While varying the lens part of novel ion mirrors, optimizing ion mirror aberrations, and analyzing parameters of field segments, we arrived to the following conclusions and rules:

1. Qualitative rules:
   - Ion mirrors composed of segmented fields allow reaching substantially better ion optical quality than prior art thick electrode mirrors. In particular, mirrors according to embodiments of the invention provide for about twice larger energy acceptances, which allows strong improvement of MRTOF resolution per flight path, while not compromising or moderately compromising other properties of thick electrode mirrors, such as spatial ion focusing and wide spatial acceptance at high (1E-5) isochronicity;
   - The optimum for ion mirrors according to embodiments of the invention appears when the field E2 in the segment containing the ion turning point has a weak field non-linearity (E0−E2)/E2 in the range of a few percent, primarily produced by penetration of a stronger field E3. Then such mirrors provide for all the desired properties, listed in the section "optimization criteria" and provide for substantial improvement the of energy acceptance compared to prior art thick electrode mirrors;
   - The optimal non linearity of the electric field near the ion turning point in E2 region is obtained by a weak penetration of electric fields from the upstream (i.e. towards the mirror entrance/exit) adjacent segment E3, where further improvements are obtained by penetration of the downstream field segment E1;
   - While using uniform field segments around the ion turning point is important, the rest of the ion mirror may be composed of either uniform field segments or may use conventional thick electrodes. The lens part may be chosen as per particular requirements of the ion mirror, where: (a) an accelerating lens provides for highest energy acceptance, normalized to ion mean kinetic energy; (b) decelerating lenses are capable of providing the same absolute energy acceptance at the same maximal mirror voltage, but at notably higher ion kinetic energies; (c) longer, multi-stage, and immersion lenses reduce time per spatial aberrations at a cost of higher lens complexity; (d) similar lens constructed with segmented fields require lower absolute voltages and provide for smaller aberrations.
2. Sweet spot parameters for two-dimensional (2D) mirrors of planar symmetry. Exact optimal parameters may slightly vary between ion mirrors with different entrance lenses, however, all systems fall into the below described range of parameters, as illustrated in FIG. 9:
   - The required electrode density in the ion reflecting segment E2 shall be supporting smoothness of the generated field better than 1%, which is achieved if the period between thin electrodes in the E2 segment is less than 0.2 of the window height H: P≤H/5;
   - Optimal strength of the reflecting field $E_0$ at the ion turning point is linked to the specific (per charge) ion mean energy $U_0=K_0/q$ and to the distance from the ion turning point to the time focal point D as $4.3<E_0*D/U_0<5$;
   - Optimal height H of ion mirror window relates to distance D: 0.04<H/D<0.06 with best results obtained in the range: 0.045<H/D<0.055;
   - The useful (for improved energy acceptance) non-linearity $(E_0-E2/E2)|X=0$ of electric field E2 at the ion turning point X=0 is between 0.1% and 10%, with better results obtained in the range between 0.5% and 5% and with very best results obtained in the range from 1% to 2%.
   - The distance X3 from the ion turning point (X=0) to the knot electrode (inter-segment electrode) U3 appears linked with the ratio of fields E3/E2 (where E3>E2) for reaching the desired field penetration and for the desired range of field non linearity in the E2 field segment, as shown in FIG. 9F;
   - While energy acceptance already improves when using at least two field segments, shown as E2 and E3 in FIG. 8, however, adding segment E1 with E1<E2 further improves energy acceptance. Usually, optimal E2/E1 ratio varies in the range from 1.01 to 1.1 with best results obtained in the range from 1.02 to 1.05.

Referring to FIG. 9, the above expressed sweet "spot rules" are illustrated by a set of diagrams 91 to 99, with annotations being presented in the scheme 90 (also matching those in FIG. 4). Simulations were made for a number of novel ion mirrors, denoted on drawing as E-steps, and composed of field segments E1, E2, E3. The lens part was varied between mirror variants, where simulated cases comprise short and long lenses, accelerating and decelerating lenses, thick electrode and segmented field lenses. Parameters of various simulated ion mirrors were normalized to the window height H, to the distance D from the ion turning point to the time focal point, and to the potential of the ion turning point $U_0$ (assuming grounded drift region). Similar normalization have been made for a number of prior art thick electrode (U-steps) ion mirrors, referred to in the introduction.

Diagram 91 shows the normalized field strength at the ion turning point $E_0D/U_0$ for novel ion mirrors (E-steps) 92, and for prior art thick electrode mirrors (U-steps) 93. Data points are aligned by the ratio X2/H, which can not be defined in thick electrode systems and is set to 0 for displaying purposes. While $E_0D/U_0$ may widely vary for thick electrode mirrors, the optimal range is narrow and well defined for novel mirrors: $4.5<E_0D/U_0<5$, with most of points clustered around $E_0D/U_0=4.6$. The result means that all novel mirrors reproduce similar optimal field distributions in the ion reflecting part.

Diagram 94 shows the normalized window height H/D for novel ion mirrors (E-steps) 95, and for prior art thick electrode mirrors (U-steps) 96. Data points are aligned by the ratio X2/H. While H/D ratio may widely vary for thick electrode mirrors, the optimal range is narrow and well defined for novel mirrors: 0.04<H/D<0.06, with most of points clustered around H/D=0.055, again meaning that novel mirrors reproduce similar optimal field distributions in the ion reflecting part.

Diagram 97 plots the field non linearity $(E_0-E2)/E2$ for novel ion mirrors at ion mean turning point (X=0), aligned with the X2/H ratio (same as in diagrams 91 and 94). The plot illustrates the central point of the invention—novel ion mirrors composed of field segments should have a non-zero optimal non-linearity at the ion turning point to provide for a notable improvement of the energy acceptance. The useful range of the reflecting field non-linearity appears $0.01<(E_0-E2)/E2<0.04$ for all simulated cases of novel mirrors. Comparing energy and angular acceptances of all simulated cases, best results are obtained in the range $0.015<(E_0-E2)/E2<0.03$.

Diagrams 97 and 98 illustrate that to reach the optimal non-linearity of diagram 97, the steps in the surrounding field shall be linked to the depth of mutual field penetration. According to diagram 98, field strength of E1 segment shall be slightly smaller than E2: E1<E2; 1.02<E2/E1<1.08. E2–E1 step grows at deeper field penetration X2/H. The useful range of penetration depth X2/H is limited to 0.8.

According to diagram 99, the field strength E3 should be in general larger than E2 (E3>E2), and the E3/E2 ratio is linked to the penetration depth X3/H by an empirical formula: E3/E2=[0.75+0.05*exp((4X3/H)−1)], that is E3/E2 grows with deeper X3/H penetration. The penetration depth X3/H is limited to 1.7.

In some exceptional cases, where the penetration depth X3/H is small, E3 can be somewhat smaller that E2; in this case the proper sign of the field strength non-linearity at the ion turning point is provided by penetration of the field E4 from the next (4-th) segment. Thus, in the most general case the ratio of field strengths E3/E2 is E3/E2>0.8 and is linked to the X3 distance by the relation E3/E2=A*[0.75+0.05*exp((4X3/H)−1)], where 0.5<A<2 to provide for a controlled non-linearity of the axial field distribution, demonstrated to enhance the energy acceptance of the ion mirror.

The above presented graphs and empirical rules tell that in all simulated cases novel ion mirrors reproduce a similar structure of ion reflecting field, characterized by a weak though controlled field non-linearity $0.01<(E_0-E2)/E2<0.04$ at the ion turning point X=0. This non-linearity is achieved by a field penetration from adjacent field segments with E1 and E3 fields, where steps in field strength E1/E2 and E3/E2 appear linked with the depth of field penetration X2/H and X3/H for improving the ion mirror energy acceptance.

Figure 10:
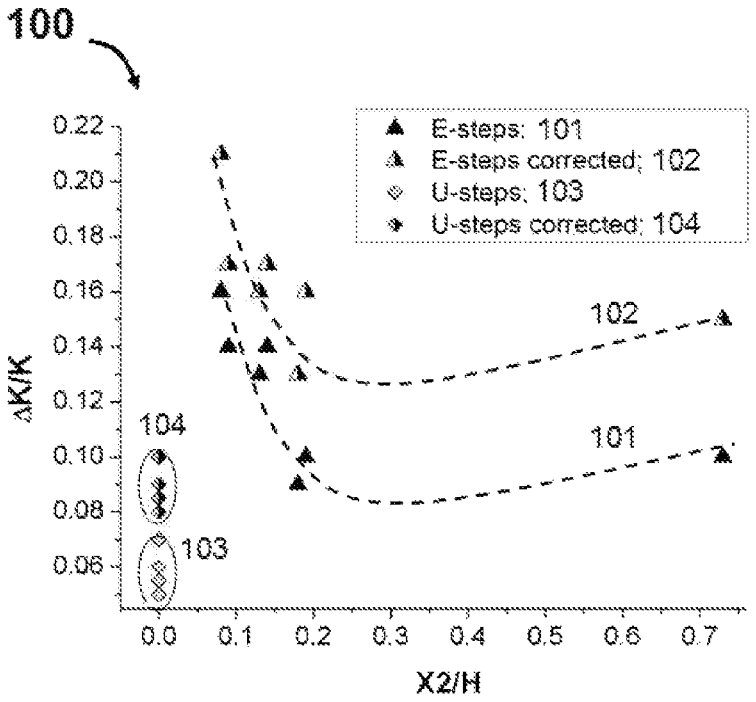
FIG. 10 compares energy acceptance for multiple novel mirrors and best examples of thick-electrode ion mirrors of prior art; Energy acceptance is notably higher for novel ion mirrors, in both cases—with and without isochronicity correction by non-zero lower-order time per energy aberrations.

Referring to FIG. 10, energy acceptances $\Delta K/K_0$ are presented for novel ion mirrors (E-steps) and for best known prior art thick electrode mirrors (U-steps). The set of analyzed ion mirrors matches the one used in FIG. 9.

Similar to FIG. 7, energy acceptances are calculated at exactly zero T|K(n) aberrations (101 and 103) and for the case of intentionally left minor residual low-order aberrations (102 and 104), maximizing energy acceptance at a given level of isochronicity, here at $\Delta T/T$=1E-5 level. Data points are aligned with X2/H, similar to graphs of FIG. 9. One can see that the energy acceptance of novel mirrors (E-steps) is about twice higher than for prior art thick electrode systems (U-steps) in both non-compensated and compensated cases. It is also apparent that novel mirrors optimize (for higher energy acceptance $\Delta K/K_0$) at either small X2/H or small X3/H (either X2/D<0.3 or X3/D<0.3), meaning that ion mean turning point shall be close to at least one field boundary to provide for a sufficient non-linearity and curvature of reflecting field at the ion turning point (X=0).

Figure 11:
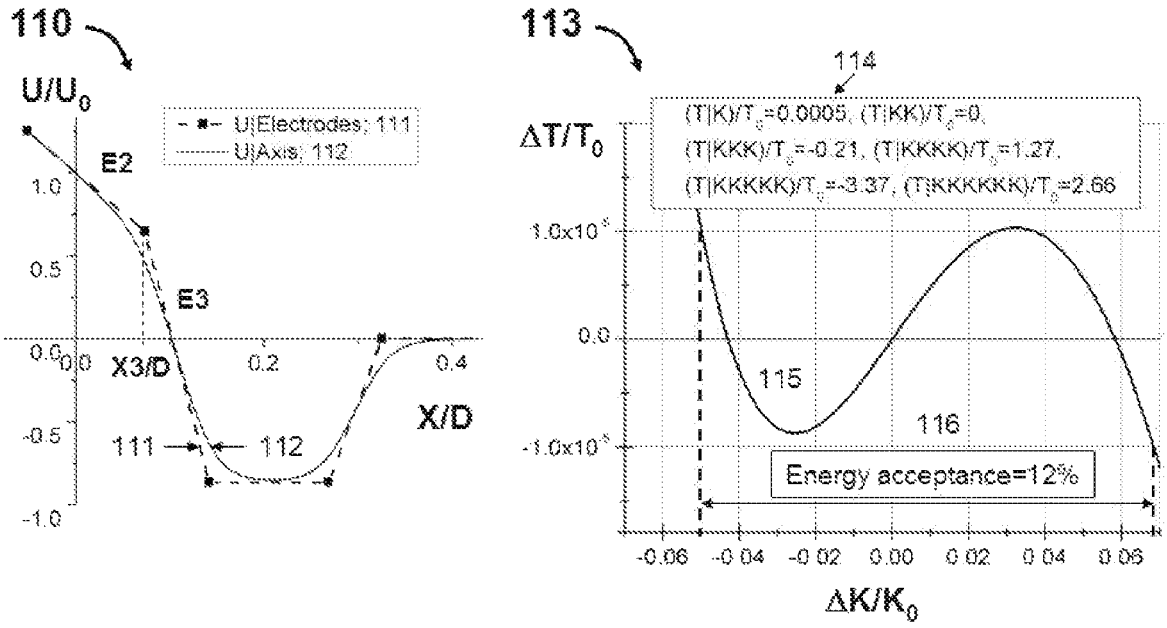
FIG. 11 shows potential distribution for one particular embodiment of a novel ion mirror composed of two field segments and presents the time per energy curve, demonstrating a compromised energy acceptance relative to above presented novel ion mirrors composed of three field segments.
Figure 12:
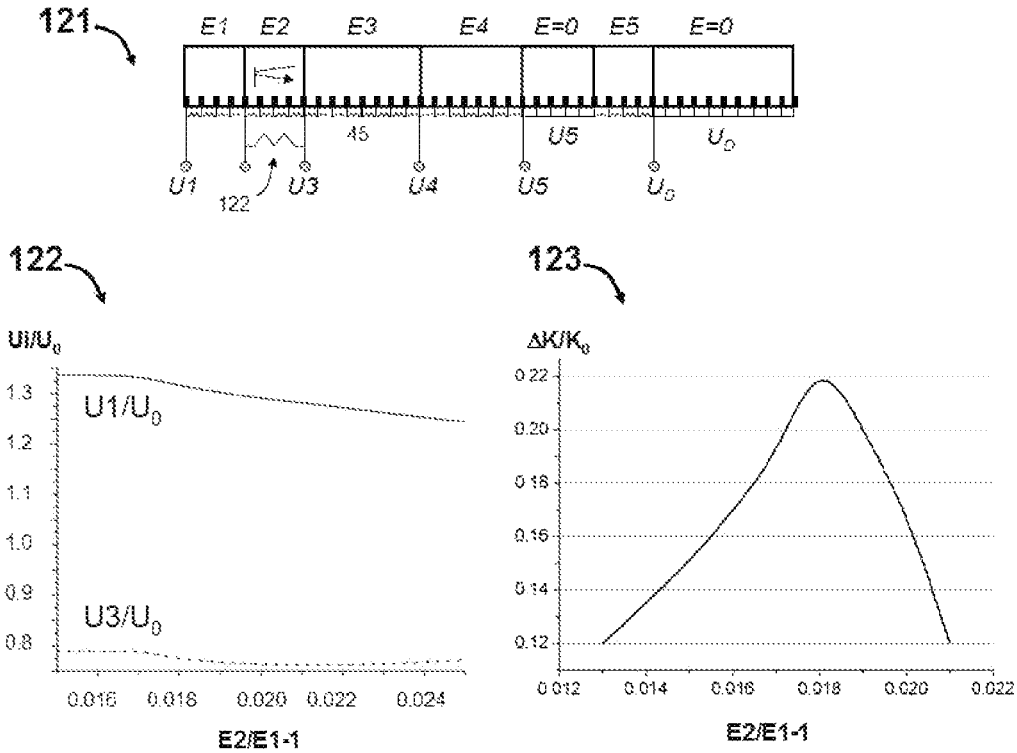
FIG. 12 shows that the number of power supplies can be reduced by using a precise auxiliary resistor, while the resistor precision shall be in the order of 0.1% to sustain improved energy acceptance of novel ion mirrors.
Figure 16:
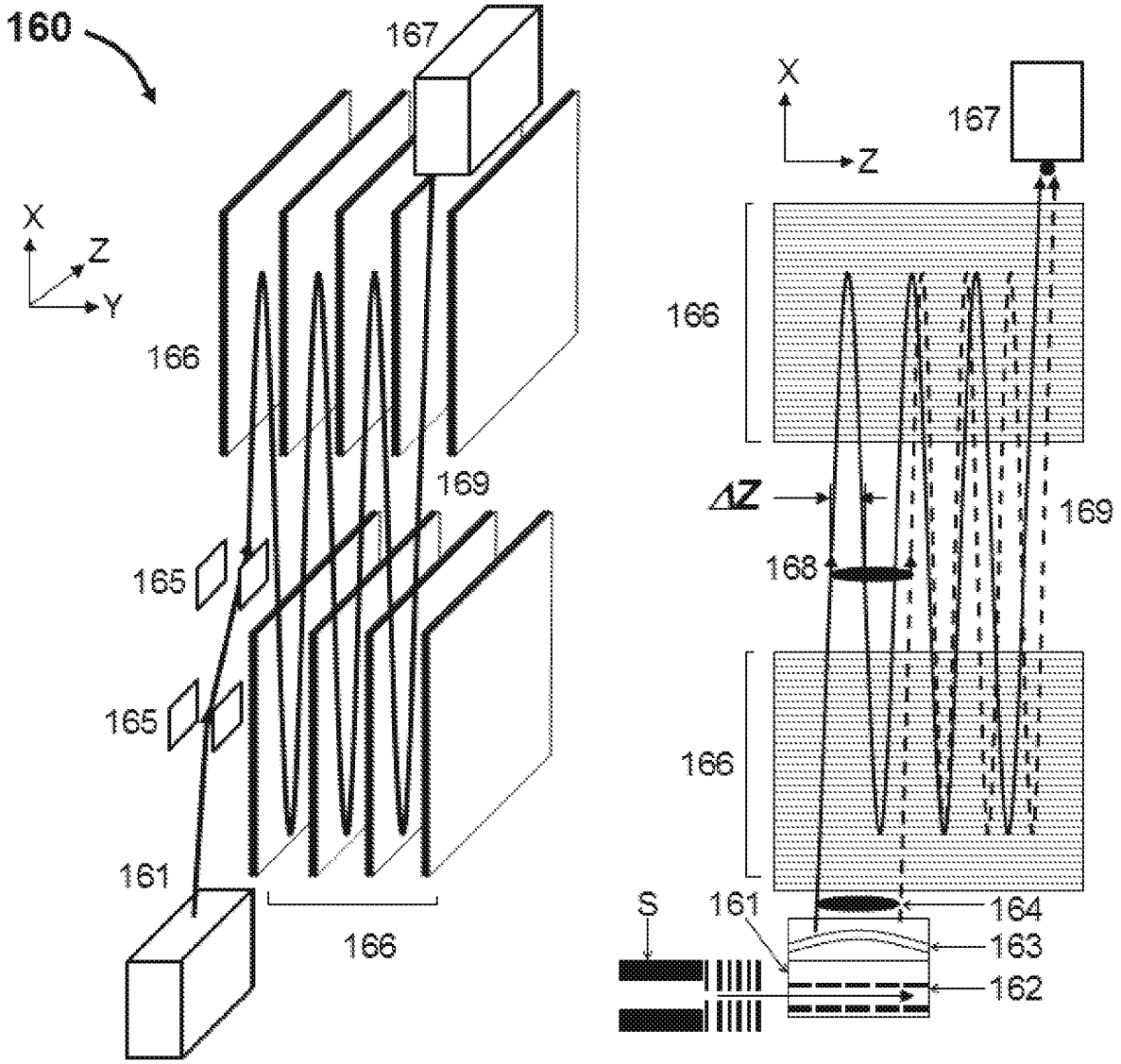
FIG. 16 shows an embodiment of the present invention with two opposed side stacks of thin gridless ion mirrors for bypassing an ion source by long ion packets.

It must be understood that the range of sweet spot parameters presented in FIG. 9 may be somewhat wider if softening requirements onto the ion optical quality of novel ion mirrors. FIG. 11 and FIG. 12 present cases of compromised novel ion mirror with reduced number of power supplies. FIG. 16 presents a case of a compromised novel ion mirror with a reduced relative width H/D and with a different balance between mirror aberrations.

Two reflecting segments: Referring to FIG. 11, graph 110 shows the potential distribution $U(x)/U_0$ Vs X/D for a simplified novel mirror; curve 111—at the electrodes, and curve 112—at the symmetry axis (Y=0). The simplified novel mirror is composed of fewer field segments to reduce the number of high voltage supplies to three, not accounting drift space supply. The reflecting part uses only two field segments E2 and E3. The non-linearity and the curvature of the E2 field at the ion mean turning point (X=0, $U=U_0$) are formed by penetration of the E3 field only, where the distance X3 from the turning point to the field boundary is about 0.075 D and is smaller than 1.5H. Graph 113 shows time per energy plot at some residual lower-order time per energy aberrations, shown in the icon 114, optimized to expand the energy acceptance $\Delta K/K_0$ to 12% at $\Delta T/T_0$<1E-5 isochronicity. The achieved energy acceptance 12% of the mirror 111 is notably lower than $\Delta K/K_0$=21% of the mirror 40 in FIG. 4. Thus, reducing number of power supplies and leaving field penetration from one side only compromises parameters of segmented ion mirror.

Referring to FIG. 12, there is shown an electrical scheme 121 for a more efficient way of reducing the number of power supplies. Accounting that the field strengths E1 and E2 are close in optimal novel mirrors (see plot 98 in FIG. 9), it is preferable omitting the U2 supply, while adjusting the E2/E1 ratio by an additional resistor 122. While using a shunt divider is an obvious step, however, it is not obvious whether reducing the number of adjustable parameters still allows mirror tuning. In practice, setting of E2/E1 ratio by the resistor 122 may be achieved within 1% routine accuracy. Plot 122 shows that inaccuracy of E2/E1 setting in the ion mirror 40 of FIG. 4 may be compensated by tuning voltages U1 and U3. Plot 123 shows that accuracy of E2/E1 setting shall be maintained with 0.1% precision in order to sustain an improved energy acceptance $\Delta K/K_0$=22% of novel ion mirrors. Thus, using shunt resistors in prior art was not supported by the knowledge of optimal mirror parameters and did not account the requirements on the divider precision.

Figure 13:
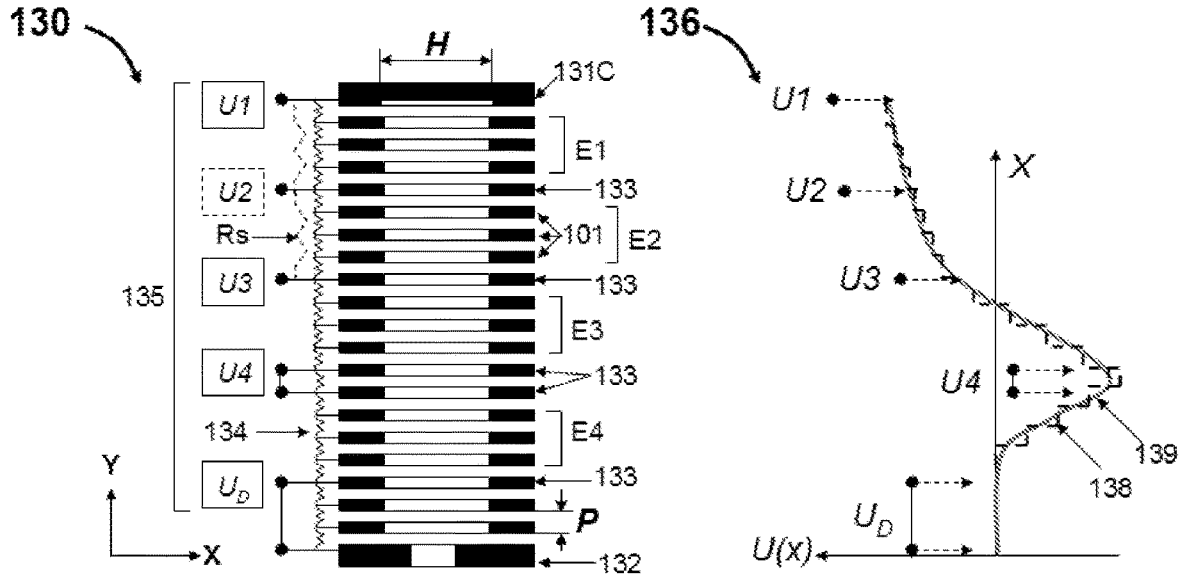
FIG. 13 illustrates the generic method of forming segmented fields in novel ion mirrors by using thin electrodes, interconnected by a resistive chain, and applying potentials to "knot" electrodes separating field segments.

Novel ion mirror embodiments: Referring to FIG. 13, embodiment 130 presents the "generic" electrode structure and electrical scheme for energizing of novel ion mirrors of the embodiments of the present invention. Stepped fields of novel ion mirrors are generated by forming several segments of linear potential distributions E1 . . . E4 at thin (per X-direction) electrodes 131, while the segments remain open to each other, i.e. not separated by grids. Thin electrodes may be formed with sheet frames or by parallel electrode rows.

Uniform fields between electrodes within each segment are supported by resistive chains 134, say, using commercially available resistors with 0.1%-1% precision and 10 ppm/C thermal coefficients. Potentials 135, denoted as U0, U1 . . . and $U_D$ are then applied to "knot" electrodes (inter-segment electrodes) 133 only. The power supply U2 may be omitted and the ratio of the field strengths E1 and E2 adjusted by additional shunt resistors Rs with at least better than 1% precision. Diagram 136 shows potential distributions: 138—at the electrodes, and 139—at the mirror axis. It is of practical importance that minor variations of individual electrode thickness or voltages are expected to be smoothed and compensated by potential tuning. To provide a reasonably uniform field at least within the E2 segment, the electrode period P in this segment shall be at least 5 times finer than the window height H: P≤H/5. Since the optimal window height H is about 1/40 to 1/50 of cap-cap distance Lcc≅2D in MRTOF, design 130 requires making physically narrow electrodes. Say, for Lcc=50 cm the above requirement converts into P<2 mm, while electrodes 131 shall be yet thinner to allow for insulating gaps. Thus, making and assembly methods shall provide for mechanical stability and straightness of electrodes 131.

Figure 14:
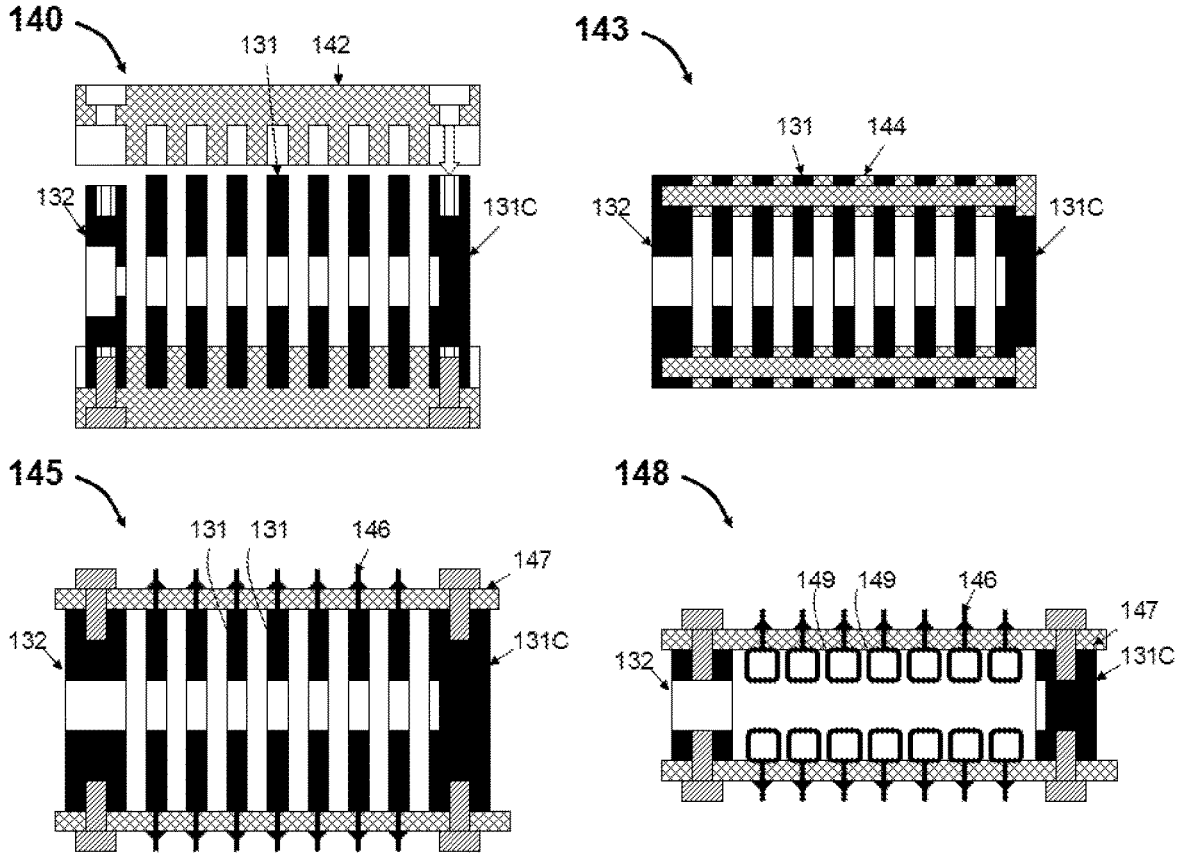
FIG. 14 shows embodiments of novel ion mirrors, constructed of thin electrodes, and presents methods for sustaining alignment and parallelism of those thin electrodes.

Thin electrodes designs: Referring to FIG. 14, novel ion mirrors 140, 143, 145 and 148 may be constructed of thin (0.5-3 mm) electrodes 131, which may be either stamped or EDM machined from a metal sheet, or made from metal coated PCB plates, or from carbon filled epoxy rods made by protrusion. Parallelism of thin electrodes is sustained by features, being particular per exemplary design.

In embodiment 140, the straightness of electrodes 131 is sustained with slots in the substrate 142, where the substrate may be either plastic, ceramic, glass, Teflon, or epoxy (say, G-10) material. A pair of opposite substrates 142 may be aligned by pins or shoulder screws in thick electrodes, such as the cap 131C electrode and the thick entrance electrode 132.

In embodiment 143, straightness of electrodes 131 is sustained by precise insulating spacers 144 at electrodes clamping with screws (e.g. made of plastic threaded rods or metal screws with PTFE sleeve). Spacers 144 may be either ring spacers or insulating sheets, both made of either plastic, PTFE, PCB, or ceramic. Electrode side shift is controlled by assembly with technological jigs and electrode displacement is prevented by tight clamping. Note that the design 143 is least preferred for accumulating inaccuracies in stack assembly and for being susceptible to electrode bend if spacers' surfaces are not highly parallel.

In embodiment 145, straightness of electrodes 131 is ensured by: (a) making initially flat electrodes (e.g., EDM made or stamped and then improved with thermal relief in stack); (b) aligning electrodes 131 with a side technological fixtures (not shown jig); and then (c) fixing electrodes 131 to the substrate 147 with connecting features 146. Preferred substrate 146 is PCB with metal coated vias. Other insulating substrates are usable, including plastic, ceramic, PTFE, glass and quartz. Preferred methods of attachment are epoxy gluing or soldering. When soldering, the preferred material for electrodes 131 is nickel 400 material, so as nickel or silver coated stainless steel. When gluing, the preferred electrode material is stainless steel. Electrodes 131 are preferably EDM machined or stamped with multiple connecting pins. Alternatively, electrodes 131 may be attached by brazing or spot welding to metal coated vias or pins in ceramic PCB. Yet alternatively, electrodes may be attached by rivets or connected by side clamps to plastic or PCB substrates.

In embodiment 148, electrodes 131 are made of carbon filled epoxy protrusion, optionally coated by metal for reducing chips and dust. The material provides an exceptional initial straightness, not achievable with metal rods. Electrodes 131 are aligned by technological jigs on each support plate 147 (PCB, plastic, ceramic, PTFE, or glass) for gluing or soldering via standoffs 146. Epoxy based PCB (like FR-4) are preferred for matching and low thermal coefficients TCE=4-5 ppm/C.

In case of using PCB supports 147, dividing chains may employ surface mount (SMD) resistors or a resistive strip generated with resistive inks, in particular developed for ceramic substrates.

Figure 15:
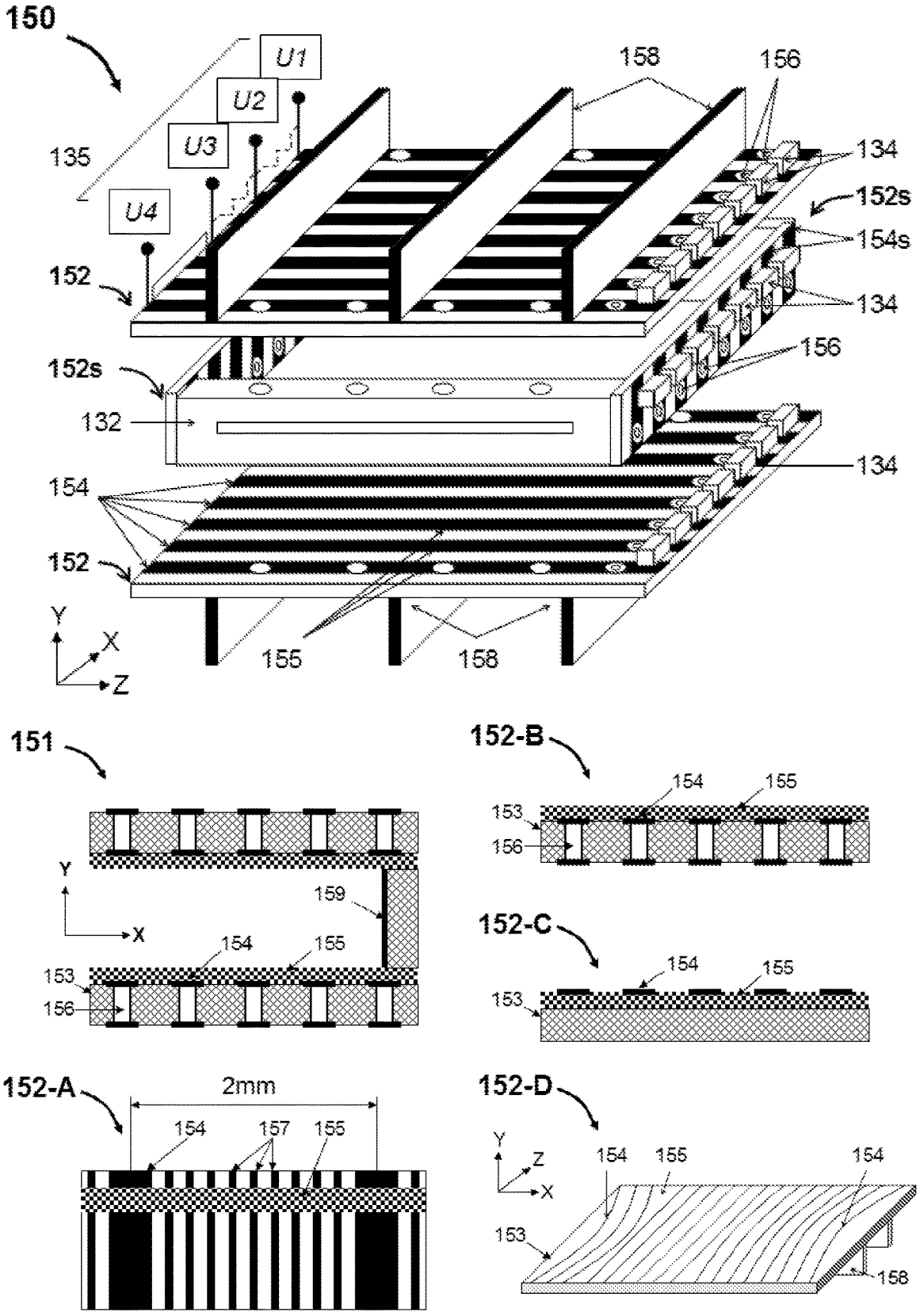
FIG. 15 shows embodiments of novel ion mirrors, constructed of printed circuit boards, and illustrates methods of generating antistatic features on isolating substrates.

PCB designs: Referring to FIG. 15, another and more preferred family of ion mirror embodiments comprises an open box 150 (2D view 151), composed of printed circuit boards (PCB) 152, exampled with PCB variants 152-A to D. Optionally, the box is enclosed with side PCB boards 152*s*. PCB technology provides standard methods of making thin conductive stripes 154 (down to 0.1 mm thick) with high precision and parallelism, specified better than 0.1 mm. Conductive stripes may be curved as shown in PCB embodiment 152-D. PCB substrate 153 may be made of epoxy resin (FR-4), of ceramic, quartz, glass, PTFE or of kapton (useful for cylindrical mirror symmetry).

Preferably, PCB plates 152 and side PCB plates 152*s* are attached to thick supports 132 with aligning pins or shoulder screws, though thick plates may be replaced by metal coated PCB 159 for better thermal match and lower weight. In this case, the overall assembly 150 is fixed by technological jigs and soldered or glued. Preferably, stiffness of boards 152 is improved with PCB ribs 158. Preferably, SMD resistors 134 are soldered on outer PCB surfaces, where connection of conductive stripes 154 to power supplies 135 and to dividing resistors 134 may be arranged either with vias 156, or with edge conductive strips, or with rivet holes, or with side clamps. SMD resistors may be replaced by a distributed resistor, formed by a paste with resistance in MOhm/square range, with the resistive paste being applied between and on top of electrodes 154. Then the dividing chain may be placed on inner box surface without making vias 156. PCB 152 may further comprise conductive lines to connecting pads for convenient connection to vacuum feedthroughs, or may have an intermediate multi-pin connector for connecting assembly 150 by a ribbon cable. PCB 152 may further comprise mounting and aligning features for assembling the overall MRTOF analyzer.

Antistatic PCB features: It is advantageous to provide antistatic properties to the inner PCB surfaces (in box 150) that may be exposed to stray ions. On one hand, it is desired that the antistatic features shall not distort the accuracy of the resistive dividers 134, at least at 1% precision, meaning that the resistance between strips may be above 100 MOhm, which corresponds to approximately 10 GOgm/square minimal surface resistance, accounting about 100:1 length to width ratio of insulating strips. On the other hand, ions scattered from nA beams may produce up to 10 fA/mm2 currents onto the insulating support. To maintain potential distortions well under 0.1V, the antistatic surface resistance may be under 10 TOhm/square. Thus, antistatic coatings do not have to be precise and uniform but could be maintained in a wide range from 1E+10 to 1E+13 Ohm/square. This is 10-100 fold lower relative to standard resistance of FR-4 PCB boards, specified at 1E+14 to 1E+15 Ohm/square.

One solution is to use ceramics substrates having lower own resistance, such as Zr02, Si3N4, BN, AlN, Mullite, Frialite and Sialon. However, ceramics are less attractive as they are higher cost and have a fragile overall construction. More favorable solutions are shown in FIG. 15. They are based on deposition of an antistatic layer or using a finer electrode structure.

Again referring to FIG. 15, PCB embodiment 152-A employs a structure of fine (0.1 mm wide) intermediate conductive strips 157 between relatively thicker conductive strips 155. Optionally, the potential drop between fine strips may be distributed by a resistive coating 155. Making local coating for a crude potential distribution is less challenging than coating the entire PCB. Besides, numerical estimates show that in the case of using fine strips 155, the self conductance of PCB in 1E+14 Ohm/square range may be sufficient even without using the resistor layer 155. Experimental tests shall be made to confirm that the PCB conductivity is reproducibly sufficient from batch to batch.

PCB embodiment 152-B shows an example of antistatic coating 155 deposited on top of PCB 153 conductive stripes 154. The coating may be then made after PCB manufacturing. Antistatic coating 152 may be formed by exposing epoxy or ceramic PCB to glow discharge with deposition of copper, aluminium, tin, lead, zirconium, or titanium. Alternatively antistatic coating may be produced by depositing conductive particles (say carbon powder) with thin polymer coating. Embodiment 126 shows example of resistive layer (similar to one used in electron tubes and scopes) under conductive stripes 121, which may be preferred for better adhesion on ceramic, quartz and glass substrates.

PCB embodiment 152-C presents a reversed case, where the antistatic coating 155 is deposited on top of PCB 153 before depositing conductive stripes.

Solving antistatic PCB properties opens an opportunity of using economy PCB for making ion mirrors. PCB technology provides an advantage of forming thin and sufficiently parallel electrodes, so as provides a convenient method of making fine resistive dividers by using economy and compact SMD resistors. PCB technology is a perfect match for novel ion mirrors. We can state that novel ion mirrors are designed for PCB technology and PCB technology is the best way of making novel ion mirrors composed of field segments.

Mirror stack: Referring to FIG. 16, a stack 160 of slim PCB mirrors (like 150 in FIG. 15) is proposed for constructing a multi-reflecting TOF with an orthogonal accelerator (OA) at a very large duty cycle. Embodiment 160 comprises: an ion source S, here shown with a gas filled RF ion guide followed by set of lenses; an elongated orthogonal accelerator 161 with the OA storage region having ion confining means 162; a trans-axial lens 163 at the OA exit; two stacks of slim PCB mirrors 166; a detector 167; and optional two pair of deflection plates 165. Exemplary ion confining means 162 are described in the co-pending application GB 1712618.6 and may include various electrostatic or RF ion guides, such as periodic lens, quadrupolar electrostatic guide, alternated quadrupolar electrostatic ion guide.

In operation, ions from the ion source S are ejected into the OA 161 and travel along the confining means 162 at a moderate energy, say, 20 to 50 eV. Periodically, pulses are applied to (not shown) Push and Pull electrodes of the OA 161, optionally accompanied by switching voltage on the confining means 162. Long ion packets (50-150 mm long) 164 are extracted from the OA, spatially focused by a trans-axial (TA) lens 163 in the Z-direction and enter a field-free space between the ion mirrors 166 at a moderate inclination angle, expected in the order of 3 to 5 degrees. Two stacks of slim PCB ion mirrors 166 are arranged for opposed ion reflections. The opposed stacks are half-period shifted in the Y-direction. Ion packets 168 get side displaced in the Y-direction at every ion mirror reflection, while being spatially focused in the Z-direction by one of the following actions: (i) either by the action of TA-lens 164 alone; (ii) or being assisted by spatial focusing of PCB mirrors with curved strips as in embodiment 152-D of FIG. 15; or (iii) by a combined action of spatially focusing TA-lens and isochronicity compensating field bows arranged within at least one PCB ion mirror. Electrostatic wedge field of PCB mirror may be used for compensating possible mirror misalignments within the XZ plane, in other words, compensating components minor rotation around the Y axis.

As a result, the long ion packet 168 does not interfere with the OA after the first ion mirror reflection, even though the ion drift displacement AZ per mirror reflection is much shorter compared to the Z-length of the ion packet 168. Ion packets are spatially focused in the Z-direction (by a TA lens, optionally assisted by curved fields in PCB mirror) at prolonged flight path, corresponding to several ion mirror reflections to focus (in the Z-direction) ion packets when they hit the ion detector 167. Thus, the novel embodiment achieves multi-reflecting TOF separation of long ion packets at fully static operation of MRTOF. Absence of deflecting pulses preserves the full mass range of mass analysis.

The embodiment 160 also illustrates that the ion injection from wider (in Y-direction) OA and into slim ion mirrors 166 may be assisted by using two pair of deflection plates 165 for side ion deflection in the Y-direction at a relatively small angle and moderate time-of-flight aberrations associated with the Y-steering. Large duty cycles of OA in the order of 20-30% are expected at static ion beam operation, and the duty cycle may be further improved to nearly unity if accumulating ions in the RF ion guide and synchronizing pulsed ion ejection with OA 161 pulses.

The stack 166 of slim (in Y-direction) and low cost PCB based TOF and MRTOF analyzers allows various known multiplexing solutions, such as: E-trap with enhanced dynamic range, as described in WO2011086430; using multiple ions sources, or increasing pulsing rate of single ion source, and using multiple channels for MS2 analysis in MS-MS tandems as described in WO2017091501 and WO2017042665.

Although the present invention has been describing with reference to preferred embodiments, it will be apparent to those skilled in the art that various modifications in form and detail may be made without departing from the scope of the present invention as set forth in the accompanying claims.

The invention claimed is:

1. An ion mirror for reflecting ions along an axis (X) comprising:

a first axial segment (E2), within which the turning points of the ions are located in use, and a second axial segment (E3), wherein the first and second axial segments are adjacent each other in a direction along said axis (X);

wherein at least the first axial segment comprises a plurality of electrodes that are spaced apart from each other along said axis (X), wherein the electrodes in at least the first axial segment have substantially the same lengths along said axis and adjacent pairs of these electrodes are spaced apart by substantially the same spacing such that these electrodes are arranged so as to have a pitch P along said axis;

wherein said plurality of electrodes define windows arranged in a plane (Y-Z plane) orthogonal to said axis (X) through which the ions travel in use, wherein the windows have a minimum dimension H in said plane (Y-Z plane);

wherein $P \leq H/5$; and wherein the mirror has voltage supplies and is configured to apply electric potentials to the electrodes of the first axial segment for generating a first linear electric field of a first strength E2 within the first axial segment, wherein $4.3U_0/D<E2<5U_0/D$, where $U_0$ is equal to a mean energy $K_0$ of an ion to be reflected in the mirror divided by the charge q of that ion, and D is the distance from the mean ion turning point to a first order energy focusing time focal point of the mirror.

2. The ion mirror of claim 1, comprising voltage supplies for applying different voltages to different electrodes of the ion mirror for generating electric fields for performing said reflecting of the ions; wherein at least the first axial segment is defined between inter-segment electrodes that are spaced apart along said axis, each of said inter-segment electrodes being an electrode to which one of said voltage supplies is connected to, wherein said plurality of electrodes in the first axial segment are arranged between the inter-segment electrodes, and are electrically connected thereto and interconnected with each other by electronic circuitry such that when the voltage supplies apply voltages to the inter-segment electrodes, this causes the plurality of electrodes to be maintained at different potentials so as to generate said electric fields.

3. The ion mirror of claim 2, wherein the plurality of electrodes in the first axial segment are interconnected to each other by a chain of resistors; wherein the chain of resistors is configured to form a substantially linear potential gradient at and along the plurality of electrodes within the segment.

4. The ion mirror of claim 2, wherein the mirror is configured such that the distance (X3) along said axis from the mean ion turning point in the first axial segment to the inter-segment electrode nearer to the mirror entrance/exit is ≤2H; ≤1.5 H; ≤IH; ≤0.5 H; in the range 0.2H≤X3≤1.7H; or in the range 0.IH≤X3≤IH.

5. The ion mirror of claim 4, comprising voltage supplies and configured to apply electric potentials to the electrodes of the first axial segment for generating a first linear electric field of a first strength E2 within the first axial segment, and to apply electric potentials to electrodes of the second axial segment for generating a second linear electric field of a second strength E3 within the second axial segment; wherein the ratio of field strengths E3/E2 is related to the distance X3 by the relationship E3/E2=A*[0.75+0.05*exp((4X3/H)−1)], where 0.5≤A≤2.

6. The mirror of claim 5, wherein the ratio E3/E2 is one of the group: (i) 0.8≤E3/E2≤2 at 0.2≤X3/H≤I; (ii) 1.5≤E3/E2≤10 at I≤X3/H≤1.5; and (iii) E3/E2≥10 at 1.5≤X3/H≤2.

7. The ion mirror of claim 2, comprising a third axial segment arranged further from an entrance end of the ion mirror than the first axial segment; and comprising voltage supplies configured to apply electric potentials to electrodes of the third axial segment for generating a third linear electric field of a third strength E1 within the third axial segment; wherein E1<E2; and wherein the mirror is configured such that the distance (X2) along said axis from the mean ion turning point within the first axial segment to the inter-segment electrode further from the mirror entrance is 0.2:S X2/H:S 1.

8. The ion mirror of claim 1, comprising voltage supplies configured to apply electric potentials to electrodes of the second axial segment for generating a second linear electric field (E3) of a second strength within the second axial segment; wherein the electrodes are configured such that the second linear electric field (E3) penetrates into the first axial segment so that the axial electric field in an axial portion of the first axial segment is non-linear where the turning points of the ions are located.

9. The ion mirror of claim 8, wherein an axial electric field strength Eo at a mean ion turning point within the first axial segment is related to the strength of the first linear electric field E2 by a relationship from the group comprising: (i) 0.01:S (Eo−E2)/E2:S 0.1; and (ii) 0.015≤(Eo−E2)/E2≤0.03.

10. The ion mirror of claim 8, wherein the electrodes are configured such that the second linear electric field (E3) penetrates into the first axial segment so that the equipotential field lines in the first axial segment are curved where the turning points of the ions are located; and/or wherein the different field strengths in said first and second axial segments produce curved equipotential field lines in a transition region between the first and second axial segments.

11. The ion mirror of claim 1, comprising a third axial segment (E1) adjacent to the first axial segment (E2) in a direction along said axis (X); wherein the third axial segments comprises a plurality of electrodes that are spaced apart from each other along said axis (X).

12. The ion mirror of claim 11, comprising voltage supplies and configured to apply electric potentials to the electrodes of the third axial segment for generating a third linear electric field (E1) of a third strength within the third axial segment; wherein the electrodes are configured such that the third linear electric field (E1) penetrates into the first axial segment so that the axial electric field in an axial portion of the first axial segment is non-linear where the turning points of the ions are located.

13. The ion mirror of claim 1, wherein the length of the first axial segment along said axis is ≤5H; ≤4H; ≤3H; or ≤2H.

14. The ion mirror of claim 1, comprising voltage supplies and configured to apply electric potentials to the electrodes of the first axial segment for generating a first linear electric field (E2) of a first strength within the first axial segment, and to apply electric potentials to electrodes of the second axial segment for generating a second linear electric field (E3) of a second, different strength within the second axial segment; so as to form a non-uniform axial electric field at the boundary between the first and second axial segments.

15. The ion mirror of claim 1, wherein at least some of the electrodes of the ion mirror are conductive strips of a printed circuit board (PCB).

16. A mass spectrometer comprising:

at least one ion mirror as claimed in claim 1;

an ion source for providing ions into the ion mirror; and an ion detector.

17. A method of mass spectrometry comprising:

providing an ion mirror or spectrometer as claimed in claim 1;

supplying ions into said ion mirror;

reflecting ions at ion turning points within said first axial segment (E2); and detecting the ions.

18. An ion mirror for reflecting ions along an axis (X) comprising:

a first axial segment, within which the turning points of the ions are located in use, and a second axial segment, wherein the first and second axial segments are adjacent each other in a direction along said axis (X); and voltage supplies configured to apply electric potentials to electrodes of the first axial segment for generating a first linear electric field of a first strength within the first axial segment, and to apply electric potentials to electrodes of the second axial segment for generating a second linear electric field of a second strength within the second axial segment;

wherein the voltage supplies and electrodes are configured such that the second linear electric field penetrates into the first axial segment so that the axial electric field in an axial portion of the first axial segment is non-linear where the turning points of the ions are located, and such that an axial electric field strength Eo at a mean ion turning point within the first axial segment is related to the strength E2 of the first linear electric field by the relationship $0.01 \leq (Eo-E2)/E2 \leq 0.1$.

19. An ion mirror for reflecting ions along an axis (X) comprising:

a first axial segment (E2), within which the turning points of the ions are located in use, and a second axial segment (E3), wherein the first and second axial segments are adjacent each other in a direction along said axis (X);

wherein at least the first axial segment comprises a plurality of electrodes that are spaced apart from each other along said axis (X), wherein the electrodes in at least the first axial segment have substantially the same lengths along said axis and adjacent pairs of these electrodes are spaced apart by substantially the same spacing such that these electrodes are arranged so as to have a pitch P along said axis;

wherein said plurality of electrodes define windows arranged in a plane (Y-Z plane) orthogonal to said axis (X) through which the ions travel in use, wherein the windows have a minimum dimension H in said plane (Y-Z plane); and wherein $P \leq H/5$;

the ion mirror further comprising:

voltage supplies for applying different voltages to different electrodes of the ion mirror for generating electric fields for performing said reflecting of the ions; wherein at least the first axial segment is defined between inter-segment electrodes that are spaced apart along said axis, each of said inter-segment electrodes being an electrode to which one of said voltage supplies is connected to, wherein said plurality of electrodes in the first axial segment are arranged between the inter-segment electrodes, and are electrically connected thereto and interconnected with each other by electronic circuitry such that when the voltage supplies apply voltages to the inter-segment electrodes, this causes the plurality of electrodes to be maintained at different potentials so as to generate said electric fields; and a third axial segment arranged further from an entrance end of the ion mirror than the first axial segment; and comprising voltage supplies configured to apply electric potentials to the electrodes of the first axial segment for generating a first linear electric field of a first strength E2 within the first axial segment, and to apply electric potentials to electrodes of the third axial segment for generating a third linear electric field of a third strength E1 within the third axial segment; wherein $E1<E2$; and wherein the mirror is configured such that the distance (X2) along said axis from the mean ion turning point within the first axial segment to the inter-segment electrode further from the mirror entrance is $0.2 \leq X2/H \leq 1$.

20. An ion mirror for reflecting ions along an axis (X) comprising:

a first axial segment (E2), within which the turning points of the ions are located in use, and a second axial segment (E3), wherein the first and second axial segments are adjacent each other in a direction along said axis (X);

wherein at least the first axial segment comprises a plurality of electrodes that are spaced apart from each other along said axis (X), wherein the electrodes in at least the first axial segment have substantially the same lengths along said axis and adjacent pairs of these electrodes are spaced apart by substantially the same spacing such that these electrodes are arranged so as to have a pitch P along said axis;

wherein said plurality of electrodes define windows arranged in a plane (Y-Z plane) orthogonal to said axis (X) through which the ions travel in use, wherein the windows have a minimum dimension H in said plane (Y-Z plane);

wherein $P \leq H/5$; and wherein the mirror is configured such that the distance (X3) along said axis from the mean ion turning point in the first axial segment to the inter-segment electrode nearer to the mirror entrance/exit is $\leq 2H$; $\leq 1.5$ H; $\leq 1H$; $\leq 0.5$ H; in the range $0.2H \leq X3 \leq 1.7H$; or in the range $0.1H \leq X3 \leq 1H$; and the ion mirror further comprising:

voltage supplies for applying different voltages to different electrodes of the ion mirror for generating electric fields for performing said reflecting of the ions; wherein at least the first axial segment is defined between inter-segment electrodes that are spaced apart along said axis, each of said inter-segment electrodes being an electrode to which one of said voltage supplies is connected to, wherein said plurality of electrodes in the first axial segment are arranged between the inter-segment electrodes, and are electrically connected thereto and interconnected with each other by electronic circuitry such that when the voltage supplies apply voltages to the inter-segment electrodes, this causes the plurality of electrodes to be maintained at different potentials so as to generate said electric fields; and voltage supplies configured to apply electric potentials to the electrodes of the first axial segment for generating a first linear electric field of a first strength E2 within the first axial segment, and to apply electric potentials to electrodes of the second axial segment for generating a second linear electric field of a second strength E3 within the second axial segment; wherein the ratio of field strengths E3/E2 is related to the distance X3 by the relationship $E3/E2=A*[0.75+0.05*\exp((4X3/H)-1)]$, where $0.5 \leq A \leq 2$.

* * * * *